US008430351B2

(12) United States Patent
Smith et al.

(10) Patent No.: US 8,430,351 B2
(45) Date of Patent: Apr. 30, 2013

(54) STRETCH FILM WINDER

(75) Inventors: David J. Smith, Topsfield, MA (US); J. Corey Michal, Beverly, MA (US)

(73) Assignee: Gloucester Engineering Co., Inc., Gloucester, MA (US)

( * ) Notice: Subject to any disclaimer, the term of this patent is extended or adjusted under 35 U.S.C. 154(b) by 385 days.

(21) Appl. No.: 12/738,155

(22) PCT Filed: Oct. 16, 2008

(86) PCT No.: PCT/US2008/011825
§ 371 (c)(1),
(2), (4) Date: Aug. 12, 2010

(87) PCT Pub. No.: WO2009/051761
PCT Pub. Date: Apr. 23, 2009

(65) Prior Publication Data

US 2010/0294876 A1 Nov. 25, 2010

Related U.S. Application Data

(60) Provisional application No. 60/980,348, filed on Oct. 16, 2007, provisional application No. 61/127,028, filed on May 9, 2008.

(51) Int. Cl.
*B65H 19/22* (2006.01)

(52) U.S. Cl.
USPC ..... 242/533.4; 242/527; 242/533.5

(58) Field of Classification Search ..... 242/527, 242/527.1, 533.4, 533.5, 554.3, 554.6, 555.5, 242/559.2
See application file for complete search history.

(56) References Cited

U.S. PATENT DOCUMENTS 2,512,900 A * 6/1950 Kwitek ..... 242/527.3
3,157,371 A 11/1964 Billingsley (Continued)

FOREIGN PATENT DOCUMENTS

DE 10 2005 000 190 A1 6/2007
EP 0 465 289 A1 6/1991

(Continued)

OTHER PUBLICATIONS

Notification of Transmittal of International Search Report and the Written Opinion of the International Searching Authority, with International Search Report and Written Opinion issued in International Application No. PCT/US2008/011825, dated Aug. 6, 2009, (30 pages).

(Continued)

*Primary Examiner* — Sang Kim
(74) *Attorney, Agent, or Firm* — Joseph M. Rolnicki; Evans & Dixon, LLC

(57) ABSTRACT

Several small diameter short width rolls (124) of plastic film (108) are wound from a larger width and length of plastic web in a continuous manner. The disclosed apparatus slits the larger width plastic web into several narrower width plastic webs, positions the slit webs on a single large diameter winding drum (110) and then winds each narrower width web at a separate winding turret (112, 114). At each turret, the plastic web is rolled around a first mandrel until the roll achieves the desired size. Then, a second mandrel contacts, the plastic web and the plastic web is severed between the first mandrel and second mandrel and attached to a second mandrel to be rolled into a roll of desired length. The process is repeated at each turret such that the several plastic webs are simultaneously wound in a continuous fashion.

16 Claims, 24 Drawing Sheets

U.S. PATENT DOCUMENTS

| | | | | |
|---|---|---|---|---|
| 3,369,766 | A * | 2/1968 | Herman | 242/527.1 |
| 3,536,273 | A | 10/1970 | Hawkins | |
| 3,622,096 | A | 11/1971 | Young et al. | |
| 3,749,328 | A | 7/1973 | Dusenbery | |
| 3,857,524 | A | 12/1974 | Melead et al. | |
| 3,889,892 | A | 6/1975 | Melead | |
| 3,944,149 | A | 3/1976 | Frezza | |
| 4,111,377 | A | 9/1978 | Tetro et al. | |
| 4,150,797 | A | 4/1979 | Kataoka | |
| 4,155,515 | A | 5/1979 | Schünmeier et al. | |
| 4,171,780 | A | 10/1979 | Bugnone | |
| 4,191,341 | A | 3/1980 | Looser | |
| 4,208,019 | A | 6/1980 | Dusenbery | |
| 4,238,261 | A | 12/1980 | Tetro | |
| 4,265,409 | A | 5/1981 | Cox et al. | |
| 4,326,679 | A | 4/1982 | Phelps et al. | |
| 4,326,680 | A | 4/1982 | Tetro et al. | |
| 4,360,170 | A | 11/1982 | Kuklies et al. | |
| 4,422,586 | A | 12/1983 | Tetro | |
| 4,422,588 | A | 12/1983 | Nowisch | |
| 4,431,140 | A | 2/1984 | Tetro | |
| 4,484,714 | A | 11/1984 | Puzey | |
| 4,489,900 | A | 12/1984 | Morizzo | |
| 4,515,321 | A | 5/1985 | Kahlman | |
| 4,541,583 | A | 9/1985 | Forman et al. | |
| 4,552,317 | A | 11/1985 | Halter | |
| 4,678,133 | A | 7/1987 | Suzuki | |
| 4,693,157 | A | 9/1987 | Looser | |
| 4,770,358 | A | 9/1988 | Suzuki et al. | |
| 4,790,491 | A | 12/1988 | Mundus et al. | |
| 4,852,820 | A | 8/1989 | Looser | |
| 4,993,652 | A | 2/1991 | Moeller | |
| 5,014,924 | A | 5/1991 | Nowisch et al. | |
| 5,054,708 | A | 10/1991 | Wiggers | |
| 5,137,495 | A | 8/1992 | Luebke | |
| 5,330,116 | A | 7/1994 | Meyer | |
| 5,367,934 | A | 11/1994 | MacNiel | |
| 5,368,291 | A | 11/1994 | MacNiel | |
| 5,620,151 | A | 4/1997 | Ueyama et al. | |
| 5,653,400 | A | 8/1997 | Narita et al. | |
| 5,660,349 | A | 8/1997 | Miller et al. | |
| 5,845,867 | A | 12/1998 | Hould et al. | |
| 5,909,856 | A | 6/1999 | Myer et al. | |
| 5,934,602 | A | 8/1999 | Jendroska et al. | |
| 6,016,988 | A | 1/2000 | Meyer | |
| 6,036,137 | A | 3/2000 | Myren | |
| 6,102,313 | A | 8/2000 | Salzsauler et al. | |
| 6,305,635 | B1 | 10/2001 | Looser | |
| 6,308,909 | B1 * | 10/2001 | McNeil et al. | 242/527.4 |
| 6,371,399 | B1 | 4/2002 | Marchante | |
| 6,422,501 | B1 | 7/2002 | Hertel et al. | |
| 6,488,226 | B2 | 12/2002 | McNeil et al. | |
| 6,729,572 | B2 | 5/2004 | Baggot et al. | |
| 6,834,824 | B1 | 12/2004 | Smith | |
| 6,874,396 | B2 | 4/2005 | Sanda | |
| 7,017,852 | B2 | 3/2006 | Perrigo et al. | |
| 7,028,944 | B2 | 4/2006 | Lindner | |
| 7,055,776 | B2 | 6/2006 | Hawighorst et al. | |
| 7,095,190 | B2 | 8/2006 | Sieber | |
| 7,314,196 | B2 | 1/2008 | Gandelheidt et al. | |
| 2005/0077415 | A1 * | 4/2005 | Hikita | 242/527.1 |
| 2006/0102274 | A1 | 5/2006 | Gandelheidt | |

FOREIGN PATENT DOCUMENTS

| | | |
|---|---|---|
| ES | 2 172 484 T1 | 3/2002 |
| GB | 177431 | 3/1922 |
| WO | WO 2004/101407 A1 | 11/2004 |

OTHER PUBLICATIONS

Notification Concerning Transmittal of International Preliminary Report on Patentability, including International Preliminary Report on Patentability, issued in International Application No. PCT/US2008/011825, dated Apr. 29, 2010 (17 pages).

* cited by examiner (Step 1002)

(Step 1004)

STRETCH FILM WINDER

RELATED APPLICATIONS

This application is the U.S. National Stage of International Application No. PCT/US2008/011825, filed Oct. 16, 2008, which designates the U.S., published in English, and claims the benefit of U.S. Provisional Application No. 60/980,348, filed Oct. 16, 2007 and U.S. Provisional Application No. 61/127,028, filed May 9, 2008. The entire teachings of the above applications are incorporated herein by reference.

BACKGROUND OF THE INVENTION

Plastic stretch films (also referred to herein as plastic webs) are typically manufactured by either a cast or blown-film high-speed extrusion process, which initially produces the film as a continuous, wide sheet. The films themselves are typically used as an industrial shipping material used to wrap and thereby hold merchandise on a pallet for shipment. The stretch wrap is applied to a load on a pallet either by a stretch wrap machine, in which case the resulting material is referred to as "machine wrap," or by an individual operator, in which the material is referred to as "hand wrap." Currently, stretch film is manufactured at too great a width for either machine wrap or hand wrap applications, so the sheet is typically reduced to standard widths prior to use. Depending on the particular manufacturing facility, the as-manufactured sheet will either be slit to the narrower width after manufacture but prior to initial winding, or wound into a full width mill roll and then slit and rewound out of line with the high-speed extrusion operation.

Historically, the "hand wrap" products were wound on the same diameter cores as the "machine wrap" products. Although core usage has always been a necessary but additional expense item for the manufacturer, a significant change is now taking place primarily in the hand wrap market; smaller, thinner, and, optimally, no cores being desirable to reduce costs and to reduce waste. With currently available winding machinery, it is not practical to make these smaller, thinner or coreless products at speeds that will accommodate winding in line with current extrusion processes, so producers are forced to wind large diameter mill rolls in line with the film extrusion process, and then slit and re-wind the film in an off-line operation. In many instances, the slitting is performed before the mill roll is wound and the rewind operation is performed without further slitting. The off-line operations increase the time and cost required to manufacture the film product sold to the end user. Additionally, to provide adequate separation between adjacent winding rolls, it is customary when slitting the film to make two adjacent parallel cuts, resulting in a narrow ribbon of material referred to as "bleed trim" that must be recycled.

SUMMARY OF THE INVENTION

There is market demand for a winder that continuously produces small diameter rolls of stretch film, both with and without cores, at high line speeds. Such a winder should allow winding of both short-length narrow width hand-wrap rolls in-line with the film manufacturing process and longer length rolls of machine wrap. A winder is disclosed having several novel aspects that may be used alone or in combination in a high-speed in-line film winder.

In the preferred embodiment, a continuously manufactured film (also referred to as a web) is fed directly from a manufacturing line onto a large-diameter surface winding drum.

The as-manufactured film is typically several meters wide. The winding drum preferably has a surface speed that is slightly greater than the manufacturing line speed, placing the plastic film, also known as a web, under a slight tension between the manufacturing line and the winding drum. A slitting mechanism positioned before the winding drum cuts the wide, continuous plastic web longitudinally into several narrow, continuous plastic webs and two "edge trims." The tension on the web between the slitters and the winding drum causes the several narrow, continuous plastic webs to further narrow from their original width as they are drawn onto the winding drum to prevent the tacky film from sticking together. The narrowing caused by their stretching results in a slight separation of adjacent edges of the several narrow, continuous plastic webs as they are drawn onto the winding drum. The preferred embodiment has a rubber "nip roll" to firmly press the film against the drum and to remove most of the air that would normally be drawn into the space between the web and the drum.

It may also be possible to impart a slight lateral stretch to the film immediately prior to the slitting station such that a natural separation is achieved without any additional tension (e.g. reverse crowned idler rolls, angled pinch rolls, etc.)

A winding turret is longitudinally aligned with each narrow, continuous plastic web across the face of the drum. Each turret supports multiple, for example, three, winding mandrels deployed about a hub. The winding mandrel, i.e. the part around which the narrower, continuous plastic web will be wound, may be configured either to accept a winding core around which the plastic web will be wound or to have the narrower, continuous plastic web wrap directly around the mandrel without a core. As a third alternative, the mandrel may be a chuck mechanism that holds a winding core, such as a cardboard core, upon which the narrow, continuous plastic web is wound. The turret itself is rotatably mounted in a support structure that includes both a motor and associated apparatus for turret rotation and a biasing means for bringing the turret into contact with the winding drum.

A transverse knife edge mechanism is associated with each turret to cut the narrower, continuous plastic web and to attach the cut film to a new mandrel to continuously create individual rolls of plastic film. The knife edge may be located on an articulated arm capable of moving the knife edge into and out of association with the winding turret and winding drum. At cutover, the knife edge is forced through the plastic web and into contact with the winding drum. The knife severs the plastic web and tends to lift and direct the severed web towards the new winding mandrel. Optionally, an air blast device is associated with the knife edge to lift the severed web away from the winding drum and lift it towards the new winding mandrel. Also associated with the knife edge is a speed matching assembly used to accelerate the new mandrel to match the speed of the surface of the new mandrel to the surface speed of the winding drum. The speed matching assembly includes both a motor and a drive wheel assembly that will accelerate the new core to line speed via friction drive from the motor. The friction drive may be, for example, a wheel spinning against the mandrel or a belt spinning against the mandrel.

The winding drum itself preferably has a hard surface to prevent damage and wear from contact with the knife edge at cutover. Also, the knife edge preferably contacts the surface of the winding drum at a shallow angle to avoid "digging into" the surface of the winding drum.

Automatic and continuous winding at each turret is accomplished according to the following steps. A first winding mandrel starts in contact with the narrow, continuous plastic web on the winding drum, winding the plastic web into a roll. As the roll grows and nears its final diameter, the turret rotates about its hub and moves a second empty winding mandrel close to the surface of the winding drum and the plastic web while maintaining the nearly completed roll in continuous contact with the winding drum. After this turret rotation the second mandrel will be "upstream" from the nearly completed roll. Following this turret rotation, the knife edge assembly, including the speed matching assembly, is brought into the pre-cutover position adjacent to the second mandrel such that the speed matching friction drive of the assembly contacts the second mandrel. In this position, the knife edge will be between the second mandrel and the nearly full roll on the first mandrel, just slightly downstream from the second mandrel and the eventual cutover position. The speed matching assembly is in contact with the second mandrel, whereupon the second mandrel is accelerated to line speed by an electric drive motor and associated friction drive mechanism of the speed matching assembly. When the roll on the first winding mandrel reaches completion, the turret rotates slightly further to bring the second winding mandrel into contact with the winding drum and the narrow continuous plastic web lying on the drum while still keeping the nearly complete roll on the first mandrel also in contact with the drum. Simultaneously, the knife edge moves into contact with the winding drum, cutting through the plastic web between the first winding mandrel and the second winding mandrel. The first mandrel winds up the free edge of the web below the knife cut such that the outer layers (wraps) on the finished product do not exhibit stretching or other imperfections seen on the outside of a roll wound on turret winders. The free edge of the plastic web above the knife cut is drawn onto the second mandrel by an adhesive material on the second mandrel, causing the film to begin winding on the second winding mandrel as the roll on the first winding mandrel finishes. The adhesive material may be, for example, a glue or a spray of water onto the mandrel at the time of the knife cut. Additionally, in a preferred embodiment, an air blast is discharged from the knife assembly in a direction parallel to the knife edge to assist in lifting the cut plastic film from the drum and onto the second mandrel. In another preferred embodiment, an air deflection enveloper can be brought into close proximity of the second mandrel such that the free end of the narrow web wraps around the second mandrel without an adhesive material.

Following the cut and transfer of the winding web to the new mandrel, the turret rotates again to move the full roll away from the winding drum. The full roll on the first mandrel, previously driven by contact with the winding drum, is either allowed to coast to a stop or, preferably, brought to a stop by a braking mechanism actuated by turret position. Finally, this turret rotation bring a previously finished roll on a third winding mandrel to a load/unload position, where the full roll is removed and that turret position is prepared for a new roll.

Automatic operation is also achieved by trimming edge trim on a roller with grooves around its circumference. A knife edge is placed in a groove to cut the edge trim, which is often poor in quality due to manufacturing processes, from the rest of the continuous plastic web. The edge trim is pulled away by a vacuum system. Occasionally, the plastic web will distort on the roll. For example, the plastic web may pull to one side if it comes loose from a roller. In such a case, the knife edge no longer cuts the plastic web and the vacuum system loses its edge trim. Lifting fingers are placed outboard of the knife edge in grooves around the circumference of the roller. When the plastic web is restored on the roller and the knife edge is trimming the edge trim, the fingers lift the newly-restored edge trim and direct it towards the vacuum system again. This restoration is automatic and does not require slowing or stopping the winding process, and does not require human intervention.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

A description of example embodiments of the invention follows.

Figure 1:
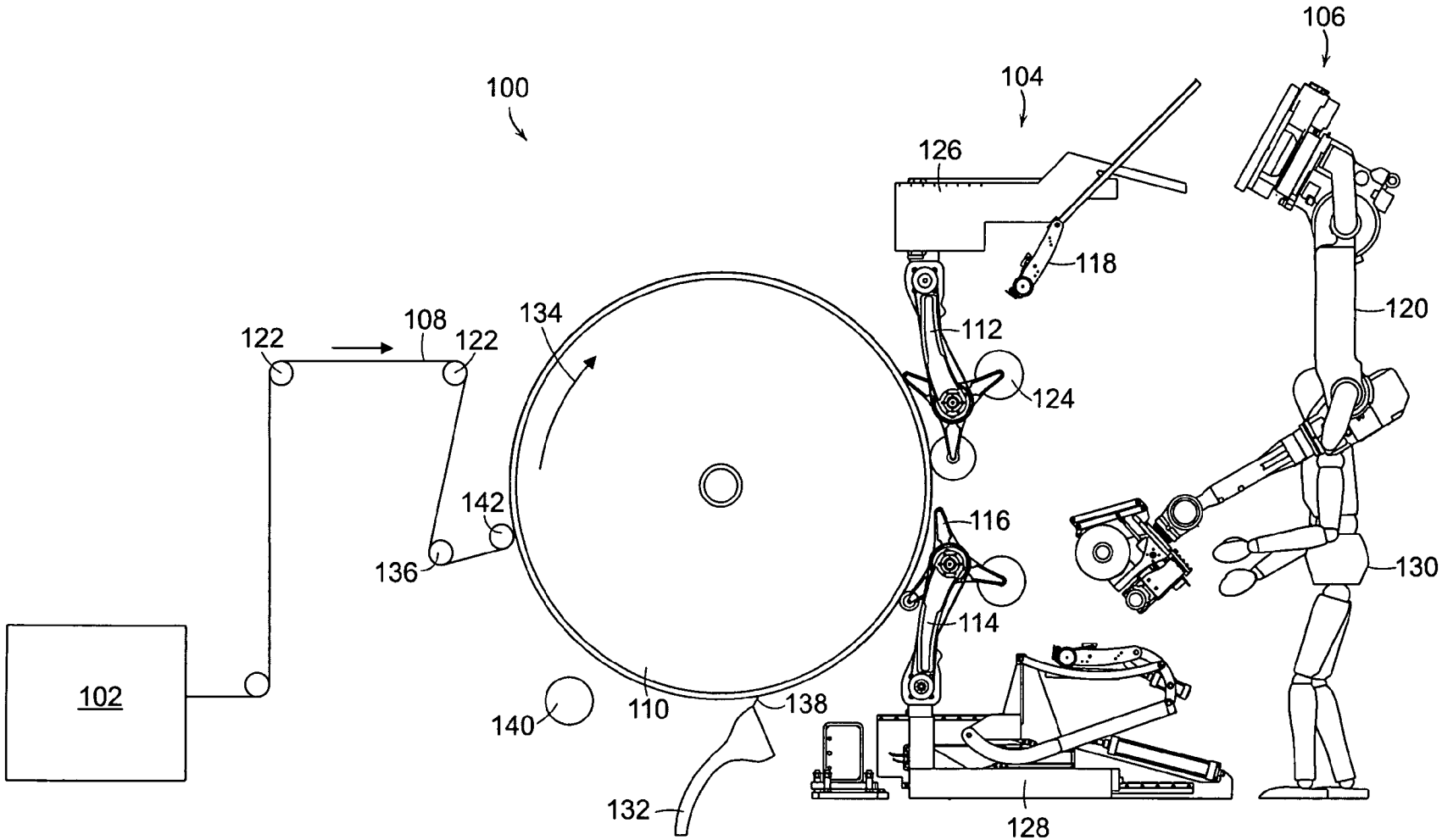
FIG. 1 is a side view of a first embodiment.

As shown in FIG. 1, a plastic film web 108 is fed from a source 102 into the winder 100. The source 102 preferably is a manufacturing line, such as a cast film or blown film line, on which the plastic web is made, i.e., the winding machine may be positioned at the end of the production line that makes the plastic web material, which can provide a practically unlimited supply of the plastic web 108. Alternately, the source 102 may be a large diameter roll of plastic film web 108 that was previously manufactured and is now being unwound and fed into the winder. As used herein, "continuous" with respect to the plastic web means that a plastic web is literally continuous or that a plastic web has a length such that processes will take a long time to use the length. The continuous plastic web 108 is fed through a series of inlet rollers 122, 136 prior to being pressed against winding drum 110 by nip roller 142. A slitting mechanism, not shown in FIG. 1, will be located at roll 136 or between roll 136 and nip roll 142 for subdividing web 108 into one or more narrow individual webs that will be wound into rolls in winding area 104. The winding drum 110 rotates in a direction to have a surface speed indicated by arrow 134 and will preferably have a hardened surface to avoid damage from repeated contact with the cutoff knife edge.

The winding area 104 in this embodiment resides on a side of the winding drum 110 opposite to inlet rollers 122, 136, where a series of winding stations 112, 114 (see FIG. 2B) arranged along the width of winding drum 110 wind the subdivided (narrow) plastic webs 202, 204, 206, 208, 210 and 212 into rolls 124. For this embodiment where six individual webs are utilized, three of the winding stations 112 are mounted above the winding drum 110 and three of the winding stations 114 are mounted below the winding drum. As shown in FIG. 2B, the winding turrets alternate between the above-the-winding-drum station 112 and the below-the-winding-drum station 114. Even though a winding turret assembly 112, 114 is wider than the individual plastic webs 202, 204, 206, 208, 210, 212 being wound, alternating between the above-the-winding-drum station 112 and the below-the-winding-drum station 114 allows adjacent plastic webs 202, 204, 206, 208, 210, 212, which are placed close together on the winding drum, to be wound on separate turrets without interference. Alternatively, adjacent plastic webs 202, 204, 206, 208, 210, 212 may be grouped in any combination and wound on the same mandrel in the same winding turret (not shown), although this typically requires removing material between the lanes, a process known as bleed trimming, and may also require either slower speeds or larger diameter shafts to avoid issues associated with shaft deflection and shaft critical speeds.

Each winding station 112, 114 is provided with a cut knife and speed matching assembly 116, 118 that will accelerate a mandrel to line speed and then sever the subdivided plastic webs 202, 204, 206, 208, 210 and 212 when a roll 124 is completed. FIG. 1 shows an above-the-drum knife assembly 118 and a below-the-drum knife assembly 116. In this embodiment, a robot arm station 106 resides beyond the winding station 104. At the robot arm station 106, one or more robot arms 120 remove mandrels and completed rolls 124 from each winding turret 112, 114 and replace them with empty mandrels in preparation for a succeeding roll change. Note that FIG. 1 also shows a human 130 in proximity to the robot arm 120. A human 130 could perform the tasks of the robot arm 120, as could any number of other mechanical devices. In view of the frequency of roll change when winding small diameter rolls at high line speeds and operator safety considerations, however, mechanical roll handling devices, such at robot 120, is preferred to a human operator 130. If a mechanical roll handling device is used, then safety interlocks should be employed to prevent humans from entering the area when the winder is operating.

FIG. 1 also illustrates a plastic web recovery device 132 located below the winding drum 110 and downstream of the winding turrets 112, 114. If one of the turret mandrels fails to pick up the plastic web 108 when starting a new roll, i.e., a missed cut, then the recovery device 132 picks up the plastic web material that failed to wind. The recovery device 132 in this embodiment is a drum surface scraping blade, i.e., a doctor blade will lift any web material 108 that passes by the turrets 112, 114 from the surface of winding drum 110 allowing it to be carried away by mechanical conveyance or by vacuum to a disposal or recycling point. The doctor blade 138 is typically in contact and oriented at a shallow angle relative to the surface of the winding drum 110. The shallow angle of the doctor blade is expected to be less than 30° (from parallel to a tangent to a surface of the winding drum), preferably less than 20°, preferably greater than 5°, and most preferably between 10° and 15°. However, other angles may also be acceptable. Optionally, an air blast device, such as a low pressure air knife, for example, can be configured to work in conjunction with the doctor blade. Finally, FIG. 1 illustrates the scrap winder 140 that it used primarily on startup. When the winding assembly 100 is to be started, the plastic web 108 material is fed around the winding drum 110 and rolled onto the scrap winder 140 until each winding turret begins winding. The doctor blade 138 will be lifted away from the winding drum during this time.

Figure 2A:
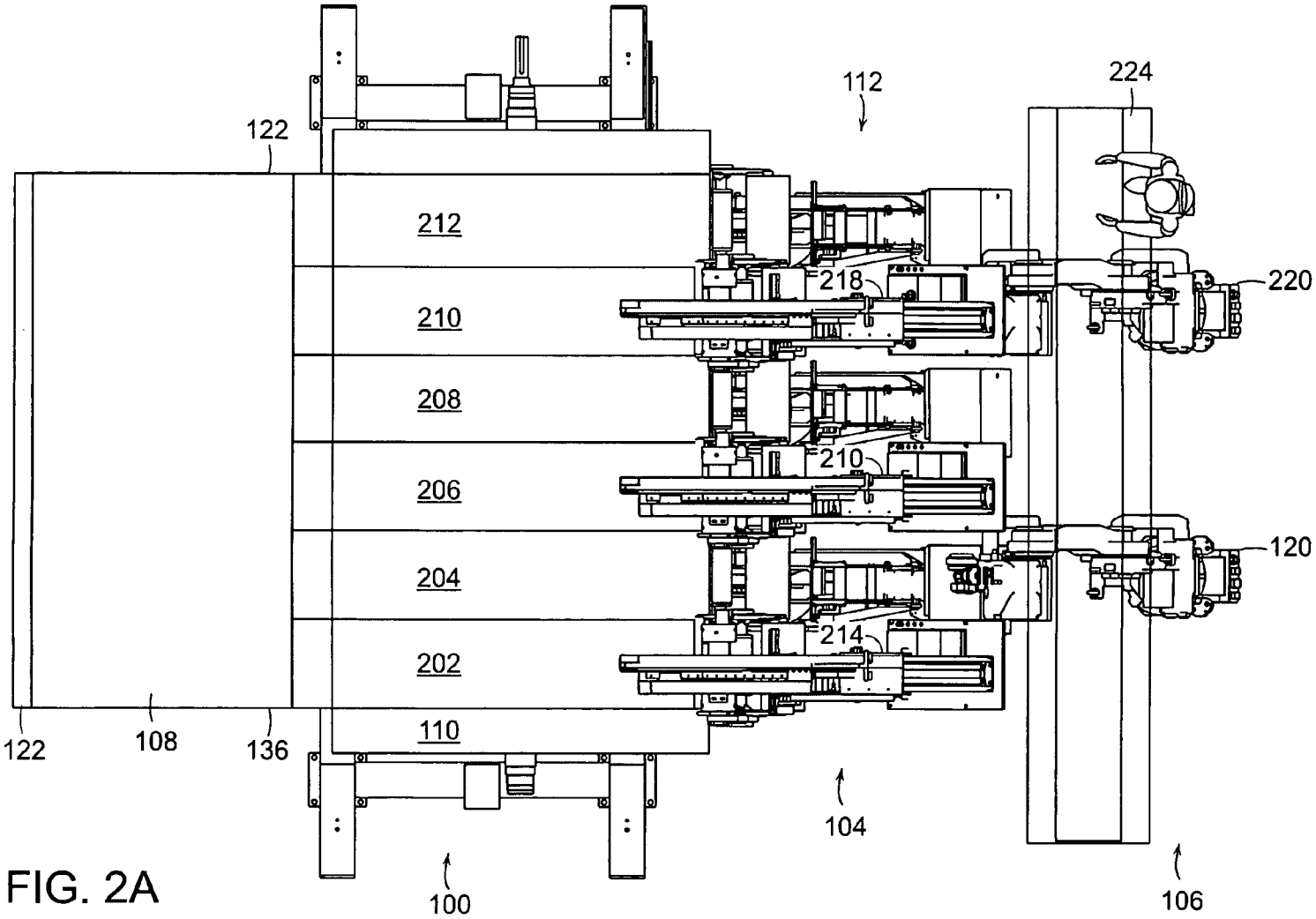
FIG. 2A is a top view of the embodiment of FIG. 1.
Figure 2B:
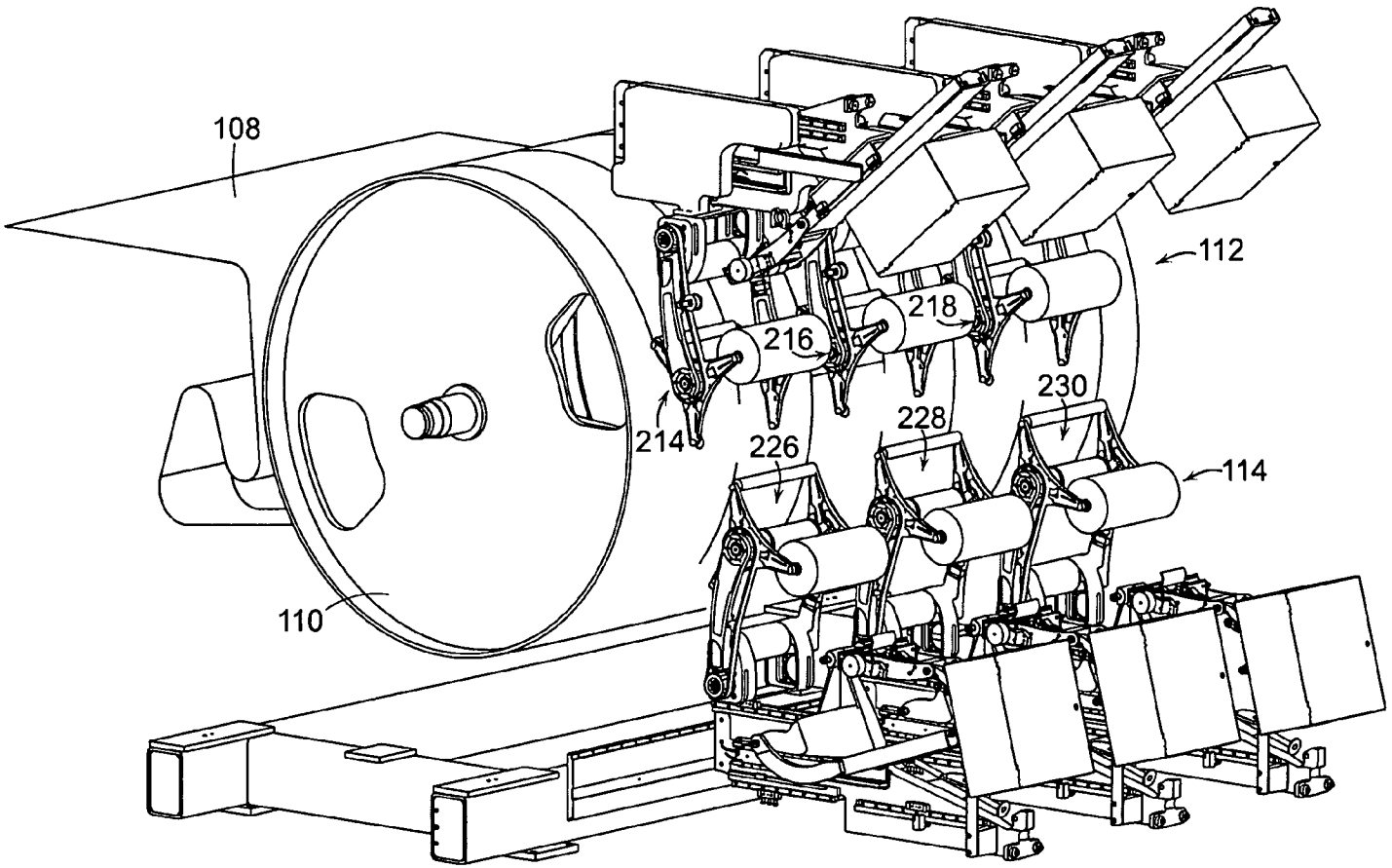
FIG. 2B is a perspective view of the embodiment of FIG. 1.

FIG. 2A is a top view of embodiment of FIG. 1. At roller 136, the continuous plastic web 108 is cut longitudinally into a plurality of narrow, continuous plastic webs and edge trims are removed (not shown). In this embodiment, the plastic web 108 is cut into six narrow plastic webs 202, 204, 206, 208, 210, 212, although more or fewer narrow plastic webs are possible. The actual number of individual narrow webs will be dependant upon the overall width of incoming web 108 and the intended width of the final end product. Also, narrow webs of different widths may be made. In the preferred embodiment, the winding drum 110 rotates at a speed such that the surface speed of the narrow plastic webs 202, 204, 206, 208, 210, 212 is slightly higher than the speed of the full width plastic web 108. The higher speed causes the narrow plastic webs 202, 204, 206, 208, 210, 212 to stretch slightly in length and narrow slightly in width, consequently slightly separating the webs from one another (the separation is not shown). This separation prevents adjacent narrow plastic webs 202, 204, 206, 208, 210, 212 from overlapping and sticking to one another or otherwise interfering with winding of separate rolls. In current stretch film winders it is necessary to remove a narrow ribbon of bleed trim from between adjacent rolls, or to steer the individual web lanes after slitting, thereby allowing the film to be wound on adjacent cores on a common shaft. Although bleed trims could be taken (or a steering mechanism used) on the winder of the current invention, the narrowing and consequent separation of the individual webs avoids the need for taking a wasteful bleed trim from between adjacent rolls and is preferred.

FIGS. 2A and 2B also illustrate three turrets 214, 216, 218 mounted in the above-the-winding-drum 112 configuration. The three turrets 214, 216, 218 will each wind one of narrow plastic webs 202, 206 and 210, while a second set of three turrets 226, 228 and 230 are mounted below-the-winding-drum 114 and will wind narrow plastic webs 204, 208 and, 212 respectively. Staggering the turrets between the above-the-winding-drum configuration 112 and the below-the-winding-drum configuration 114 allows the turrets to be mounted directly over each narrow plastic web 202, 204, 206, 208, 210, 212 without interfering with each other, even though the turret machinery is necessarily wider than the narrow plastic webs. The turrets may be moved longitudinally along rails to allow for different web widths. FIG. 2A also illustrates two robot arms 120, 220 in this embodiment. The two arms are capable of maneuvering to interface with mandrels on any of the six turrets 112, 114 of this embodiment. More or fewer robot arms may be used to satisfy the needs of a particular operation.

Figure 3:
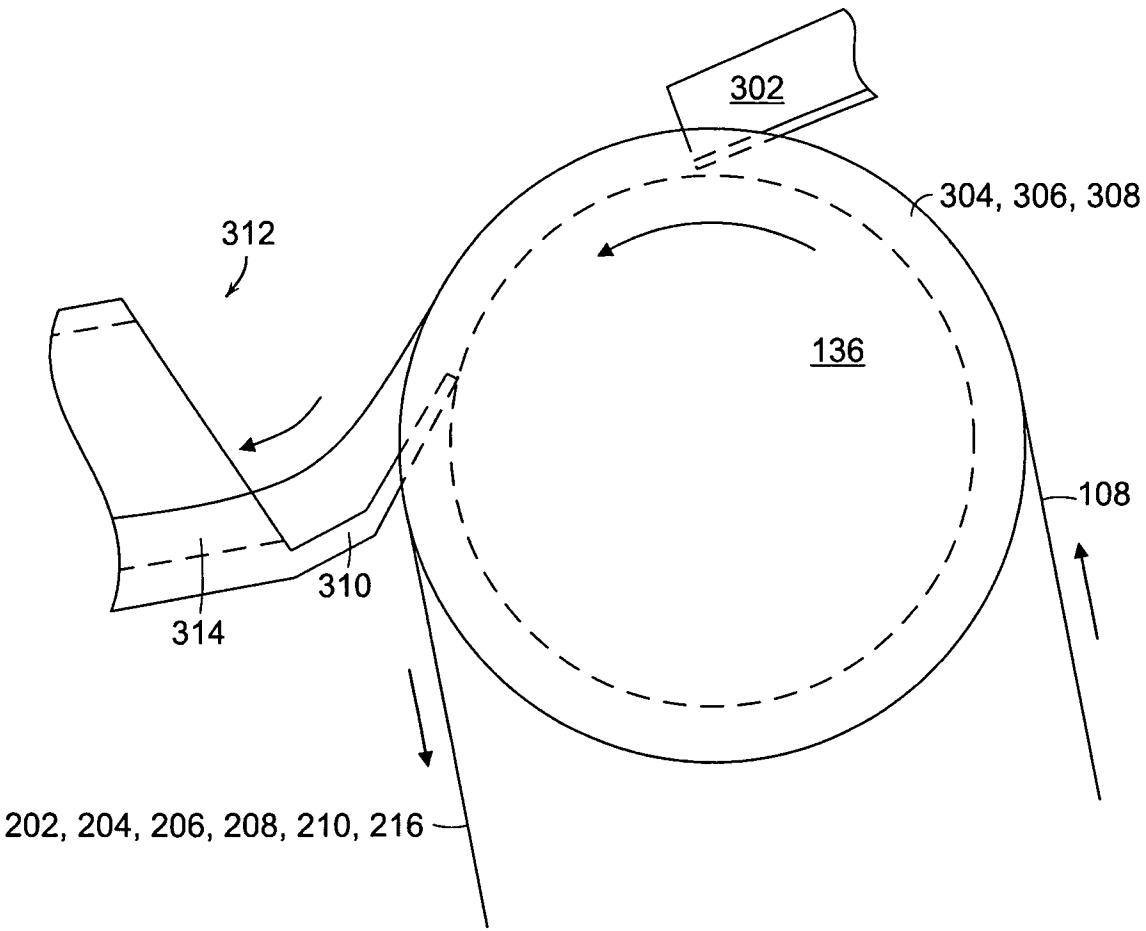
FIG. 3 is a side detail view of a roller with grooves and lifting fingers for an edge trim cutting position.
Figure 4:
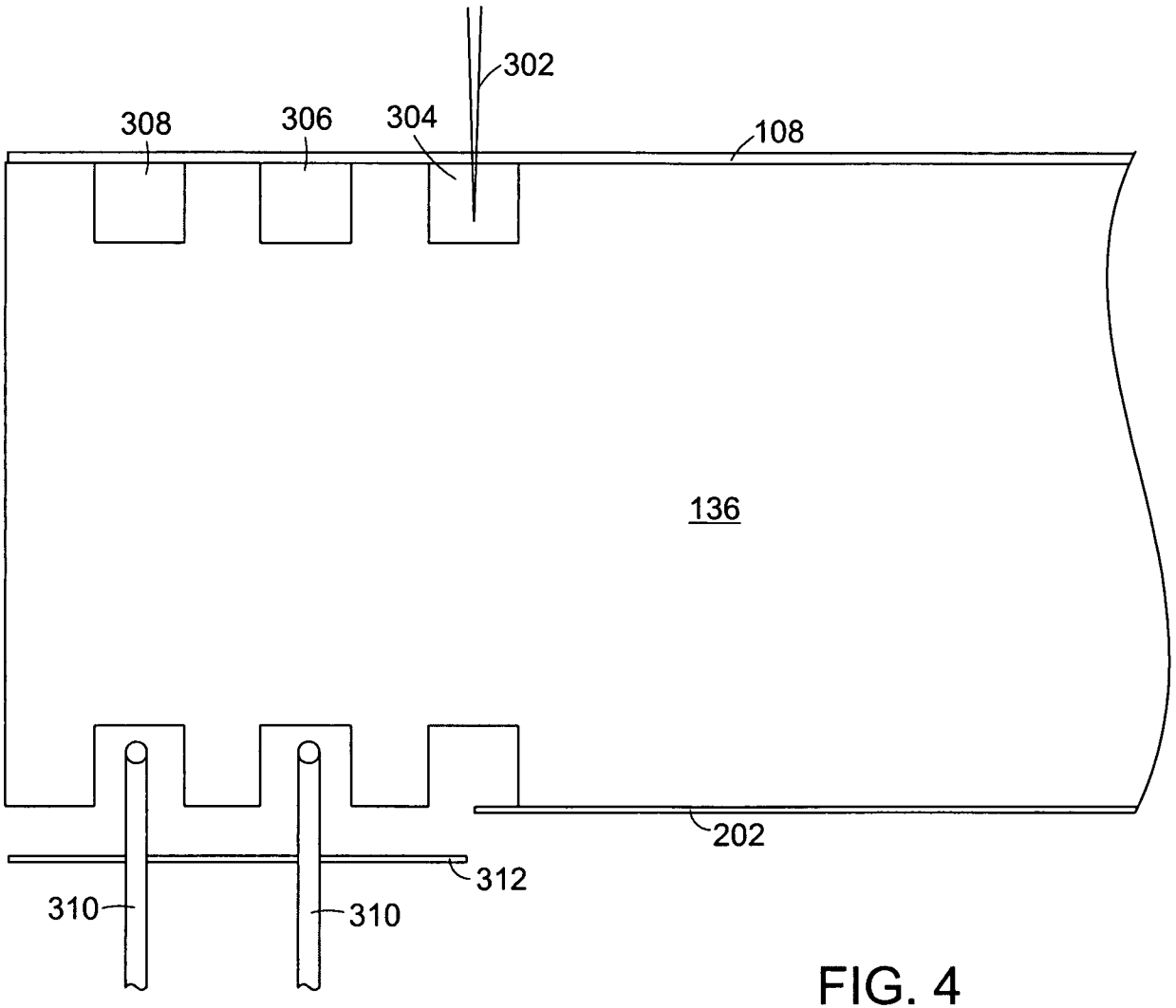
FIG. 4 is an exaggerated front detail view of the roller of FIG. 3 with grooves and lifting fingers for an edge trim cutting position.

As previously indicated, web 108 is subdivided into individual narrow plastic webs at or near roll 136. One slitting arrangement is shown in FIGS. 3 and 4. In the preferred embodiment, knife edge 302 run in groove 304 cut into the surface of roller 136, As shown in FIGS. 3-4, the knife edge cuts the edges from the plastic web 108, i.e. the edge trim. Similar knife edges slit the plastic web 108 into narrow plastic webs 202, 204, 206, 208, 210, and 212. The surfaces of roller 136 on either side of each groove 304, 306, 308 provides support for the web to allow the knife edge to cleanly cut the plastic web 108. The cuts in the plastic web 108 to form the narrow plastic webs 202, 204, 206, 208, 210, 212 do not result in any waste material, while the cut that form the edge trims, at least for cast film applications, typically a few inches on either side—are cut off to remove defects inherent in the cast film process. After cutting, however, the edge trim must be removed from the roller 136 for disposal or recycling. FIGS. 3 and 4 illustrate an embodiment of the edge trim knife edge 302 running in a groove 304 on roller 136. Normally, this is performed unsupported and the edge trim is pulled away from the roller in a continuous fashion by a vacuum 314. Not specifically shown, but familiar to one of ordinary skill, knife edge 302 may oscillate within groove 304 to distribute wear on the knife edge. As shown in FIG. 4 two grooves 306, 308 that are further outboard of groove 304 are mated with fingers 310 that run in the outboard grooves to prevent the trimmed edge 312 of the plastic web from continuing around the roll. The fingers 310 direct the trimmed edge into a vacuum take away system 314 or a conveyor belt (not shown) that removes the trim 312 from the area. Note that at least one finger may run in the same groove as the knife edge so long as the finger is outboard of the knife edge. Preferably, there will be additional grooves to allow longitudinal adjustment for different web widths. Optionally, there will also be an air nozzle used to assist the transfer of the edge trims into the pickup tube.

The edge trim knife edge 302 and fingers 310 allow a trimming system to automatically recover from a temporary loss of an edge of the plastic web. During the production of cast stretch film, the edges of the plastic web are typically attached (pinned) to a roller using static electricity or air jets to maintain the film in its flat shape and prevent the film from narrowing undesirably while molten. Occasionally, the edge pin is lost and the edge of the web may move out of contact with the edge trim knife edge 302. When the edge recovers, it will be automatically cut by the knife edge 302 and the fingers 310 will direct the edge trim to the vacuum 314.

Figure 5:
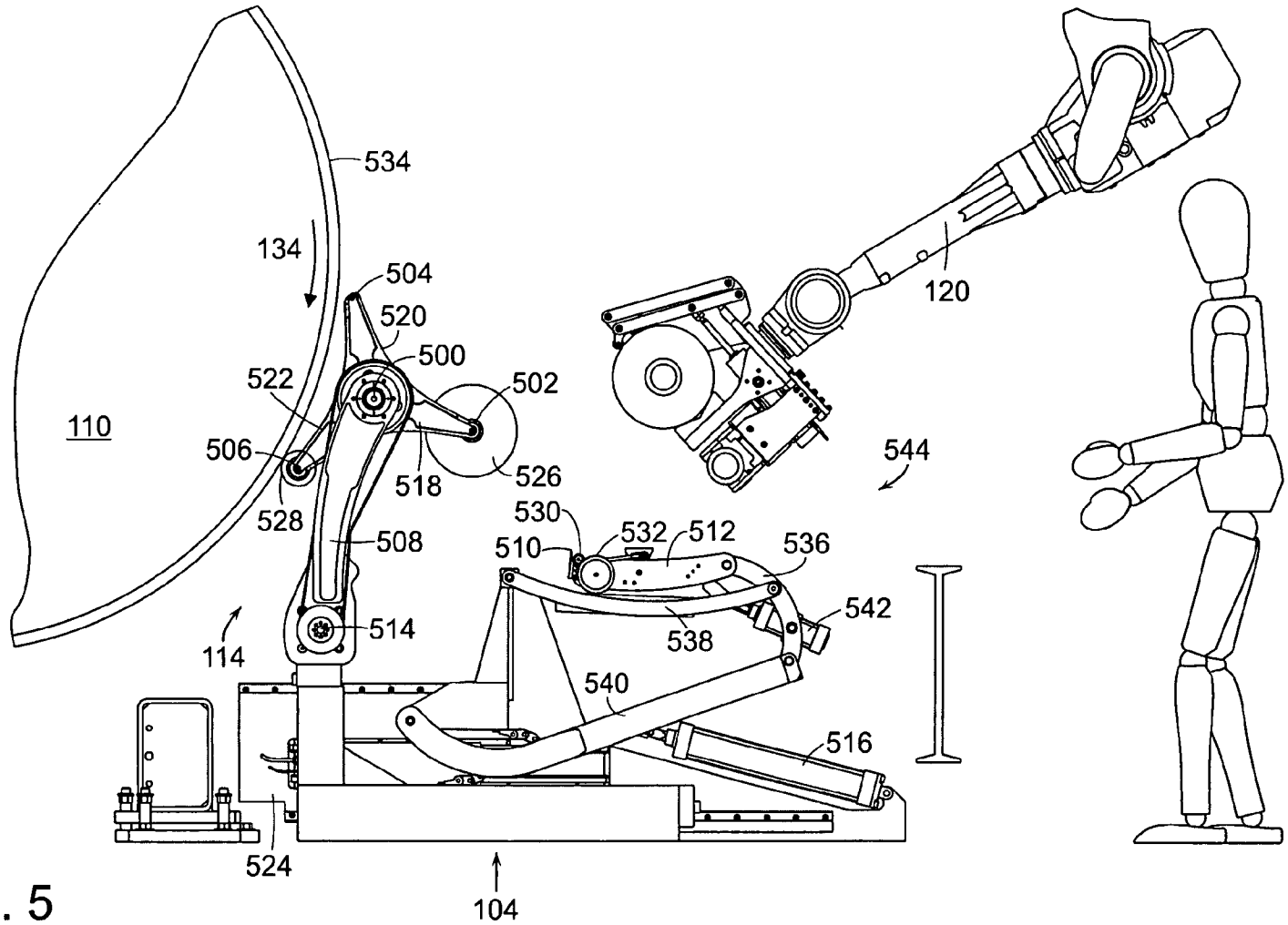
FIG. 5 is a side detail view of a turret assembly according to the embodiment of FIG. 1.
Figure 6:
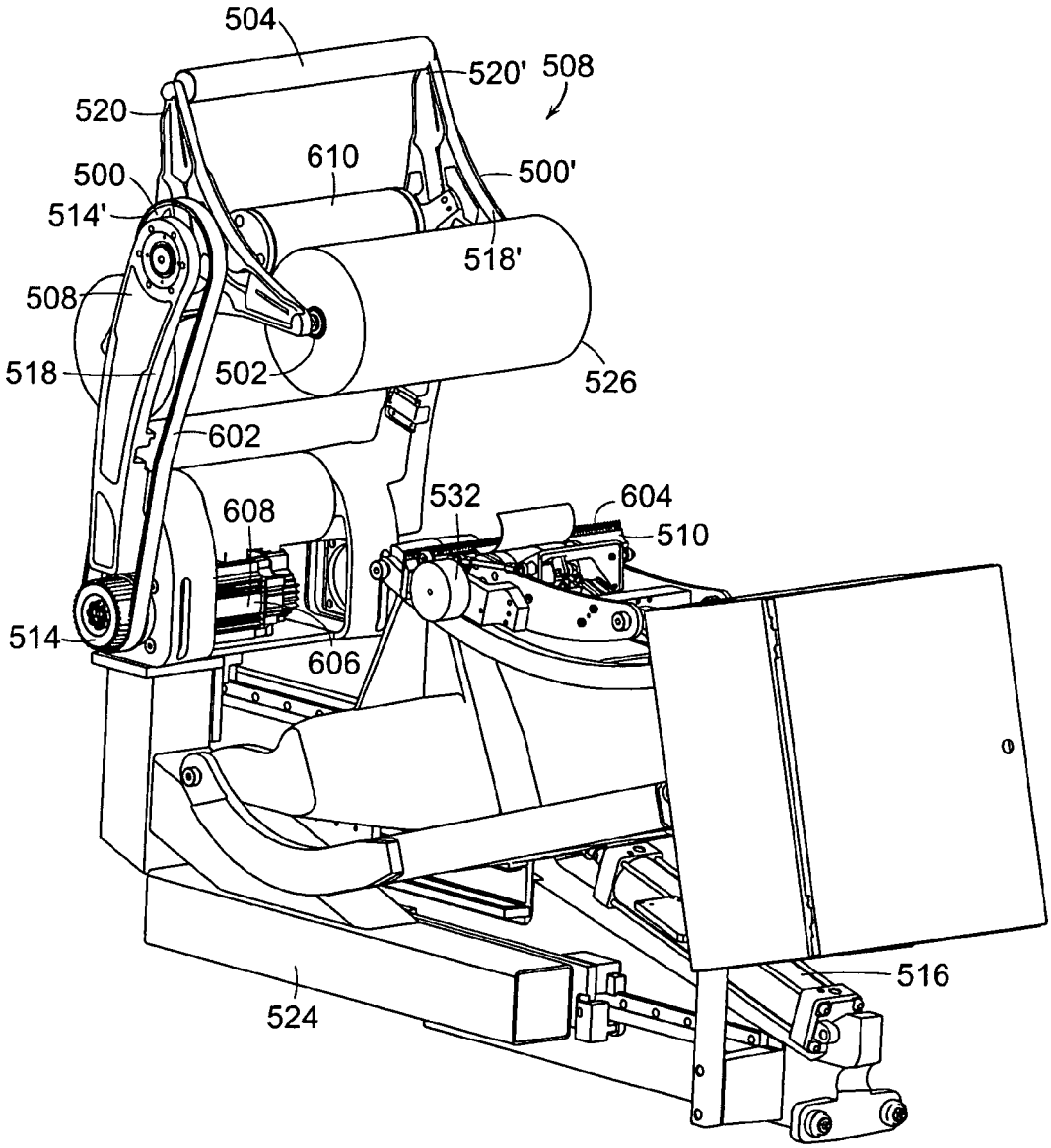
FIG. 6 is a perspective detail view of a turret assembly according to the embodiment of FIG. 1.

FIGS. 5 and 6 illustrate closer detail of one of the below-the-winding-drum turrets 114 according to the embodiment of FIG. 1. Although one of the below-the-drum winding turrets is shown, it is representative of all the turrets in the winder. Each turret comprises a left turret hub 500 and a right turret hub 500', each having three radial arms 518, 520, 522, 518', 520' 522' with each hub 500 500' joined by turret arbor 610. The hubs 500, 500' include stub shafts and bearings (not shown) so that the turret assembly may rotate when mounted in turret yokes 508. As shown in FIG. 6, turret assembly 114 is rotated by electric motor 606 and reduction gearbox 608 through drive pulleys 514 and 514' and belt or chain 602. Electric motor 606 is preferably an electric servo motor to provide accurate position and/or contact force throughout the winding cycle. Alternatively, the hub 500 could include a compact electric servo motor to rotate the turret, thereby eliminating the separate electric motor 606, pulleys 514, and belt or chain 602. In either case, motor 606, gearbox 608 and any related drive equipment must be capable of rotating turret 114 against the combined winding force and live loads of any rolls on the turret and yet be able to be turned by the reaction force on turret 114 when the motor is relaxed to bring an empty mandrel into contact with the drum during the cut cycle.

Mandrels 502, 504, 506 are mounted between the outboard ends of radial arms 518, 520, 522, 518', 520' and 522. Each mandrel 502, 504, 506 is mounted between its respective radial turret arm 518, 520, 522, 518' 520' and 522' and is parallel to the longitudinal axis of the winding drum 110. Although FIGS. 5 and 6 show a turret assembly in which each mandrel 502, 504, 506 is supported by arms on each side, an alternate turret assembly could comprise radial arms 518, 520, 522 on only one side with mandrels 502, 504, 506 mounted to the arms 518, 520, 522 in a cantilever fashion. Also, each mandrel may be configured to support the entire length of a winding core, may be configured (for example, integrated into the radial arms) to have the plastic web wound directly on its surface, or may be configured to support only the ends of a winding core.

In FIG. 5, mandrel 502 is shown with a fully wound roll 526 prior to removal by the robot arm 120, roll 528 on mandrel 506 is in contact with winding drum 110 as roll 528 is being wound, and mandrel 504 is empty and in positioned to make contact with the winding drum 110 when the roll 528 on mandrel 506 is fully wound. Each turret arm 518, 520, 522 may also have a friction braking mechanism intended to stop a full roll from rotating after it is disengaged from the winding drum 110 following cutover.

Figure 7A:
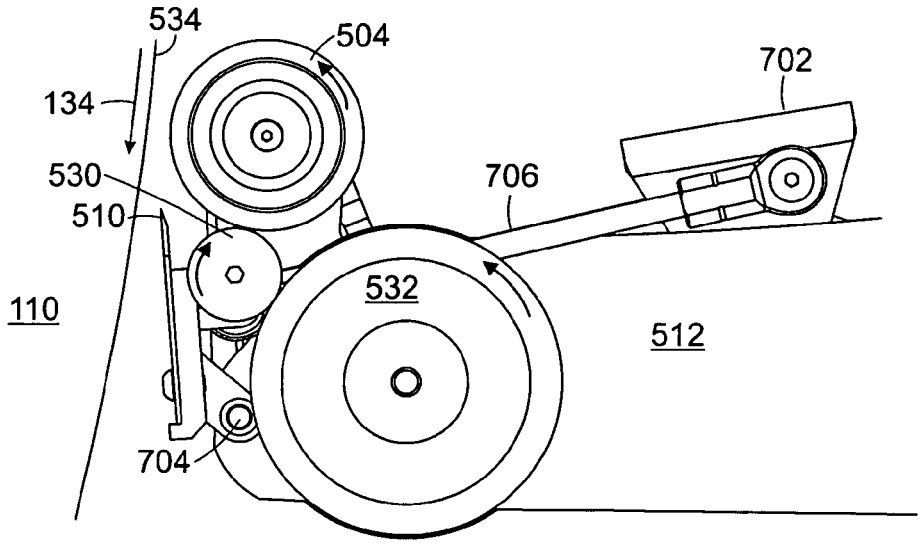
FIGS. 7A-7F are side detail views of a cutoff knife assembly and relate linkages and actuators.

FIG. 5 also illustrates a pivoted cut and transfer assembly 544. As shown, a hinged knife edge assembly 510 is attached to a rotating mounting arm 512, which in turn is attached to a linkage comprising arms 536, 538, 540. Rotation of arm 512 is accomplished by actuator 542, while rotation of the linkage comprising arms 526, 538 and 540 is controlled by actuator 516. In FIG. 6, knife edge 510 is shown with a serrated edge 604. As shown in FIG. 5, in addition to knife edge 510, mounting arm 512 also carries drive wheel and motor assembly 532 and speed matching wheel 530. When roll 528 nears the desired size, actuator 516 extends and the mounting arm 512 and knife edge 510 are inserted into turret assembly 114 above mandrel 502 and between mandrels 504 and 506 (as shown in FIG. 1). As shown in FIG. 7A, speed-matching wheel 530 is brought to rest against mandrel 504 to properly orient the knife edge 510 close to mandrel 504, while drive wheel and motor assembly 532 also makes contact with speed-matching wheel 530 to accelerate and match the surface speed of mandrel 504 to the surface speed of winding drum 110 prior to cutting the film. When the surface speed of mandrel 504 is at the same surface speed as winding drum 110 and roll 528 on mandrel 506 has reached its full size, the knife edge 510 cuts the plastic web 534 slightly downstream from mandrel 504, separating the web from winding roll 528 and the plastic web starts winding on mandrel 504 to create a new roll (not shown).

The speed matching wheel 530 may also be a belt drive that contacts the mandrel to accelerate and speed match the mandrel to the drum.

Figure 7B:
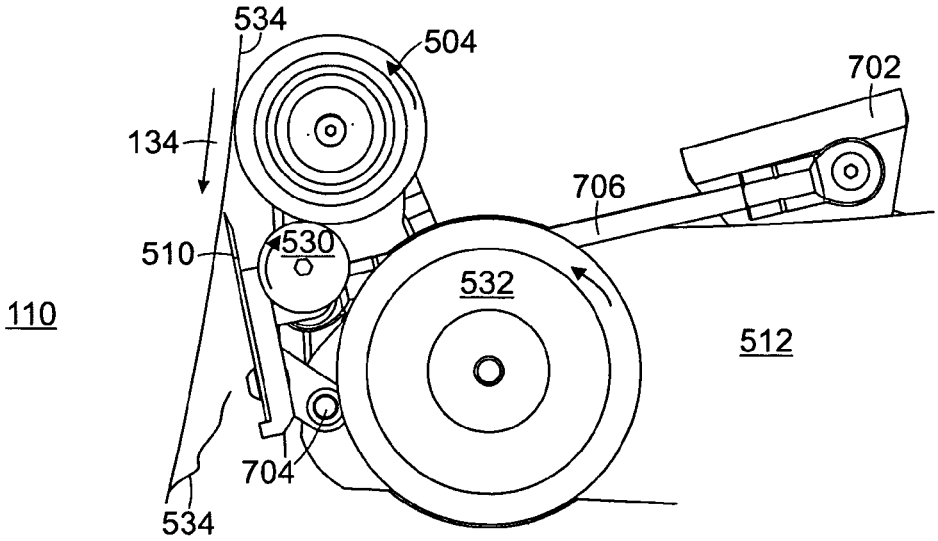

The details of the cut and transfer mechanism and of the transfer process are shown in FIGS. 7A to 7F. The knife edge 510 cuts the plastic web 534 by being pushed by actuator 702 and connecting rod 706 against web 534 and onto drum 110. The knife edge 510 is attached to mounting arm 512 by hinged carrier 704. The actuator 702, for example, a pneumatic cylinder or a solenoid, quickly extends the knife edge 510 to contact the winding drum 110 and plastic web 534 as shown in FIG. 7B. In this embodiment, the knife edge 510 returns to its stored position a short time after it is brought into contact with web 534 and drum 110 as knife edge 510 severs the plastic web 534 almost instantly. As shown, the speed-matching wheel 530 is attached to the same hinged carrier 704 as knife edge 510 so that the speed-matching wheel 530 loses contact with the drive wheel 532 when the knife edge 510 is brought into contact with the web and winding drum. The knife edge 510 contacts the winding drum 110 at a shallow angle, preventing the knife edge from digging into the winding drum surface 110. The shallow angle is less than 30° (from parallel to a tangent line of the winding drum), preferably less than 20° and more than 5°, and most preferably between 10° and 15°. Additionally, the tips of the knife are specially ground to minimize bending and digging into the roll surface. As previously indicated, drum 110 has a relatively hard surface to prevent damage from repeated contact by knife 510. After the cut is made, the knife edge 510 and mounting arm 512 are retracted by actuator 516. Alternatively, the speed matching may be accomplished by other means, including but not limited to a belt-type friction element described earlier, which would not pivot with the knife holder. Also, the knife edge may have other means of locating relative to the mandrel prior to cutting the plastic web 534.

Figure 7C:
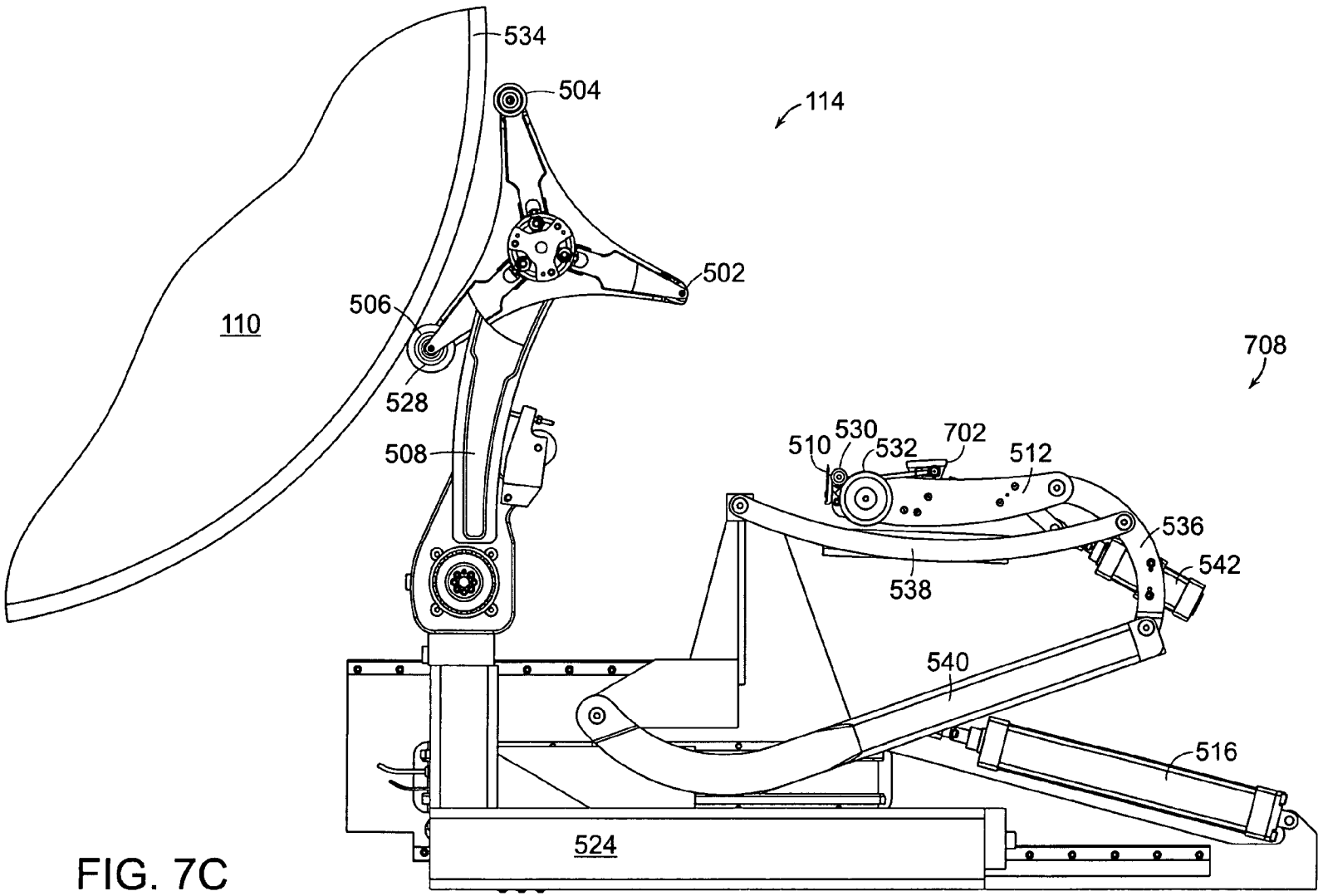
Figure 7D:
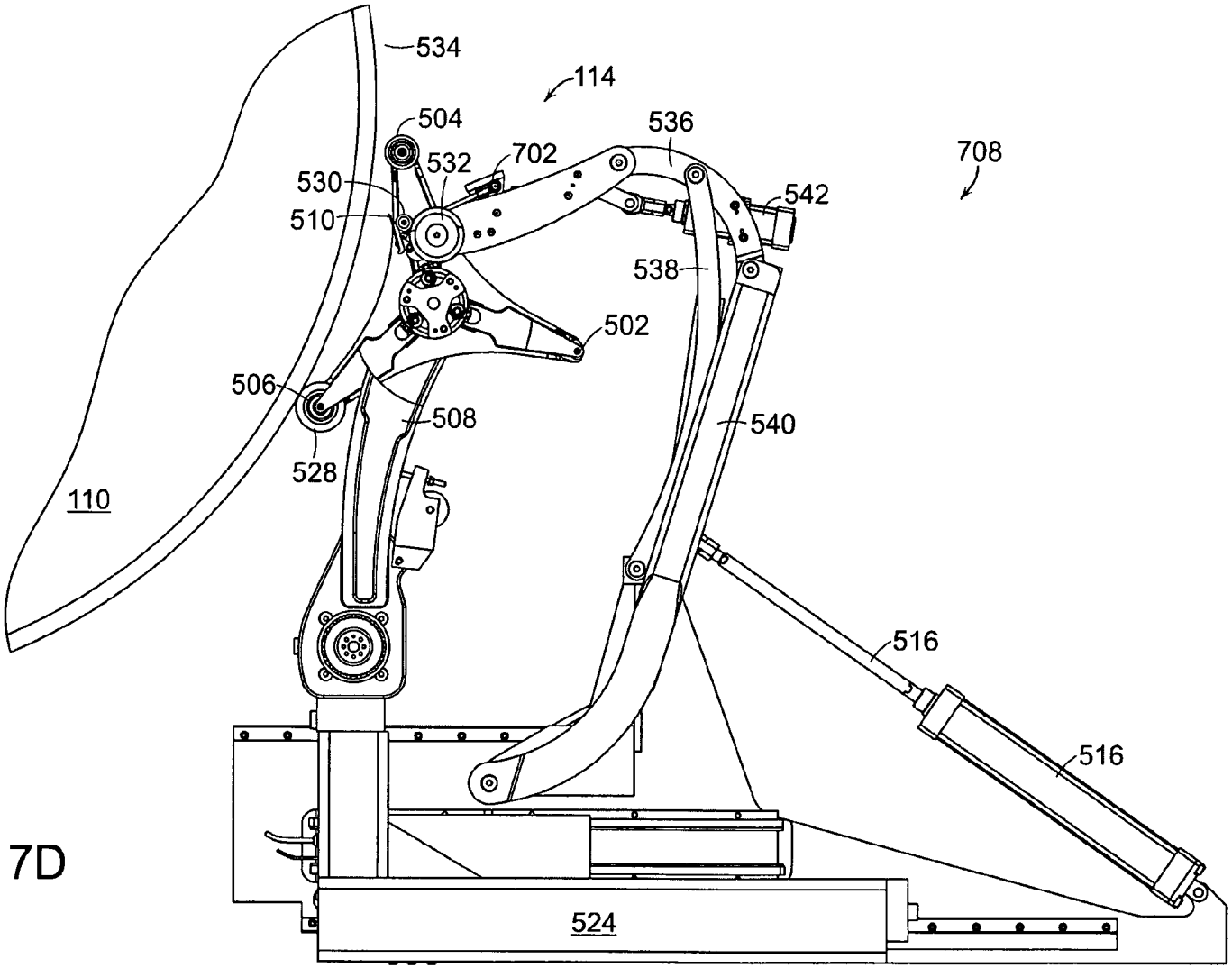
Figure 7E:
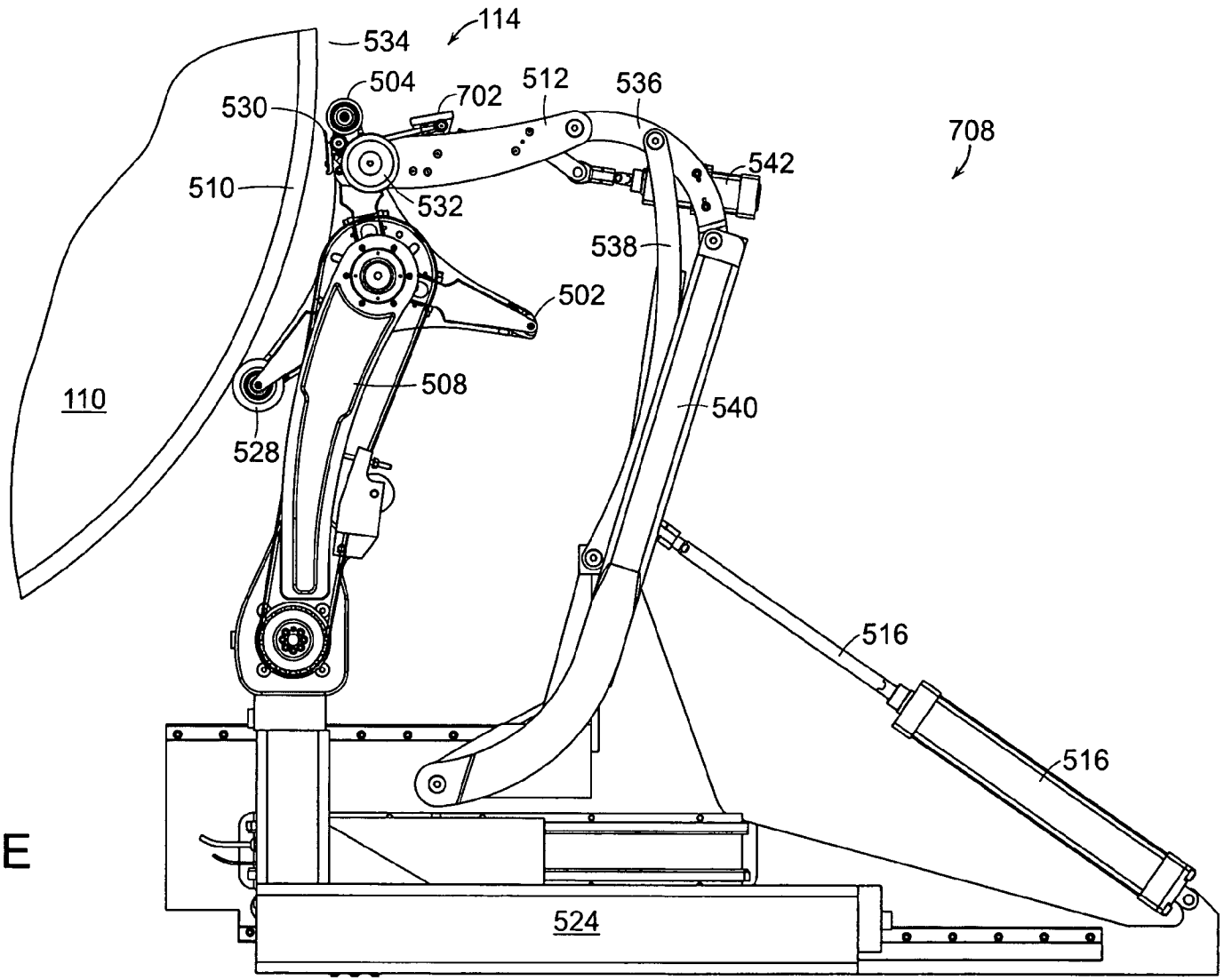
Figure 7F:
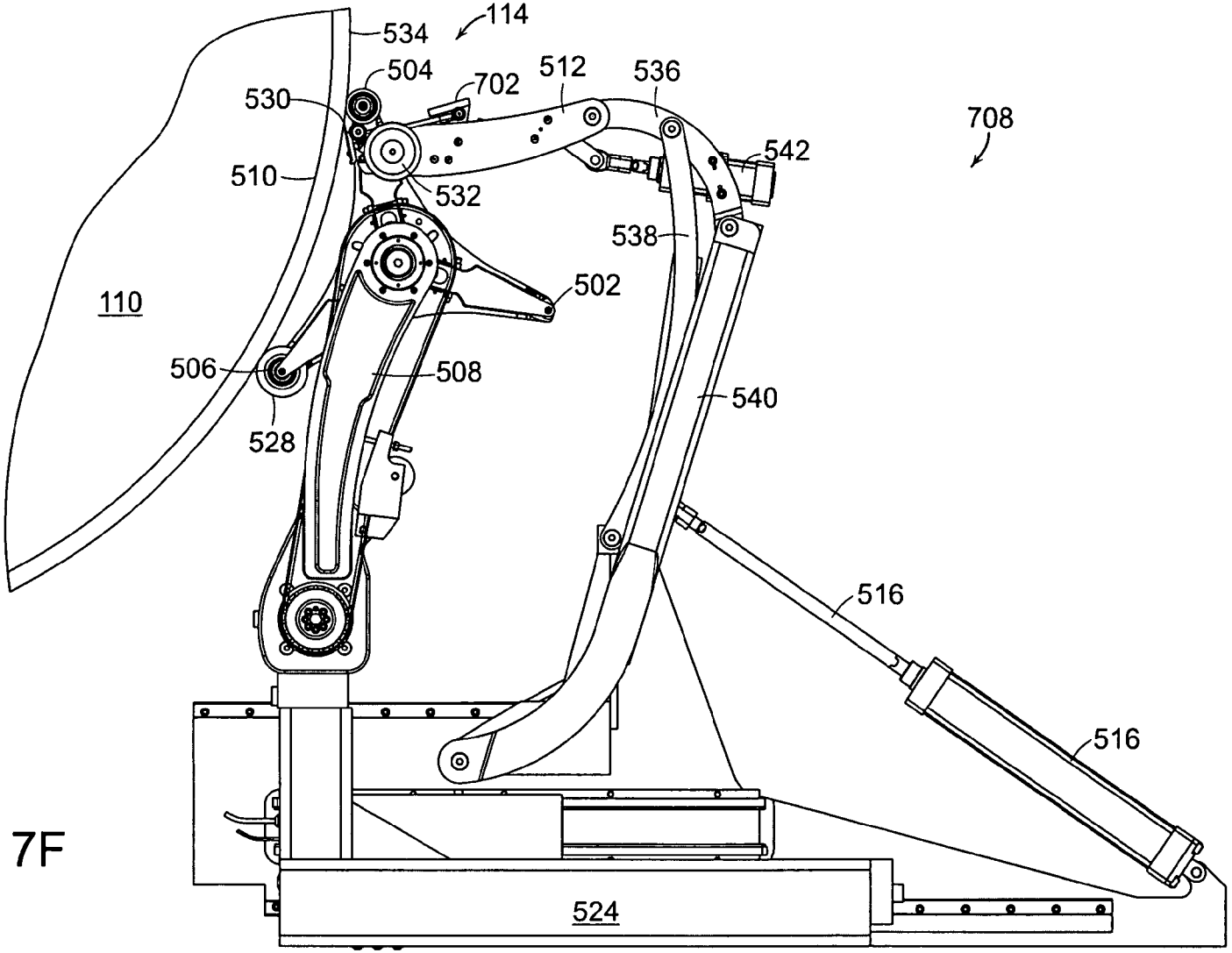

FIGS. 7C-7F illustrate the motion of the knife positioning assembly 708 in a below-the-winding-drum turret 114. In FIG. 7C, the knife edge 510 is shown attached to mounting arms 512, 536, 538, 540 and actuators 516, 542. In FIG. 7C, actuators 516, 542 are fully retracted, folding the knife edge assembly 708 out of the way of robot arms 120, 220. In FIG. 7D, actuator 516 has extended, raising mounting arms 538, 540 which pivot such that mounting arms 512, 536 translate up and toward mandrel 504 on the winding turret 114. In this state, mounting arm 512 is too low for the speed-matching wheel 530 to contact the mandrel 504. As shown in FIG. 7E, actuator 542 extends, which causes mounting arm 512 to pivot and raise speed-matching wheel 530 to contact mandrel 504. Now, knife edge 510 is also in position to cut the plastic web 534 upon extension of actuator 702. Finally, FIG. 7F shows mandrel 504 in contact with winding drum 110 and knife edge 510 extending via actuator 702 to contact winding drum 110 to cut the plastic web 534. The knife edge assembly 708 in the bottom-of-the-winding drum turret 114 configuration makes this four-step movement to access the cutting position immediately below new mandrel 504 but to avoid interfering with robot arms 120, 220 when not in use. In this embodiment, knife edge assembly 708 cannot access the cutting position immediately below new mandrel 504 because of shaft 610 (see FIG. 6) that runs through the middle of the turret 114. In the above-the-winding-drum turret 112 configuration, the knife edge assembly 118 of the described embodiment also has to be brought into position below the mandrel and raised until the speed matching wheel 530 makes contact with mandrel 504. However, the above-the-winding-drum turret 112 configuration allows the knife edge assembly 114 to extend to the cutting position immediately below the new mandrel, and also to approach and retract in a straight line (diagonally down and towards or up and away) without interfering with the robot arms 120, 220. This system also accommodates various mandrel diameters and/or core thicknesses with minimal changes or adjustments to the hardware.

FIG. 5 also shows the turret 114 and knife edge 510 and transfer assembly 544 mounted on a chassis 524. Portions of the chassis are moved by a drive, in this embodiment a linear motor, employed to move the turret 114 towards and away from the winding drum 110 to maintain desired roll contact force with the winding drum during winding, turret rotation and roll diameter change. Other portions of the chassis 524 are fixed and carry the knife edge 510 and transfer assembly 544. The movable portion of the chassis 524 may be driven towards and away from the winding drum 110 in one of two modes: position mode, in which the moveable portion of the chassis 524 is moved to a specific position; and force mode, in which the moveable portion of the chassis 524 exerts a determined amount of force against the winding drum 110 via the mandrel(s) 502, 504, 506 of the turret 114. The chassis 524 (both the moveable and fixed portions) can be moved parallel to the longitudinal axis of the winding drum 110 when the machine is shut down to align with a plastic web. Such movement of the entire chassis 524 may be desirable when configuring the winding machine to wind a different size or number of plastic webs. By moving the chassis 524 to translate and rotate the turret hub 500, the mandrels can be oriented such that only one mandrel/roll is in contact with the winding drum 110 or two mandrels/rolls are simultaneously in contact with the winding drum 110. For example, FIG. 5 shows only mandrel 506 and roll 528 in contact with winding drum 110. Mandrel 504 can also be brought into contact with the winding drum 110 by rotating hub 500 counter-clockwise according to this view. The chassis drive responds in force mode to maintain the force of roll 528 against the drum 110 as roll 528 also rotates with the turret. The chassis 524 is also moved away from the winding drum in the force mode as a roll (such as roll 528) builds on a mandrel (such as mandrel 506) to maintain a desired pressure and contact between the roll and the winding drum 110.

FIG. 5 illustrates an embodiment of a below-the-winding-drum 114 turret with three arms. A turret with four or more arms would also be possible. The maximum number of arms will be limited by the requirements for space including, among others, space for the knife edge 510 between the arms of a turret.

Figure 8A:
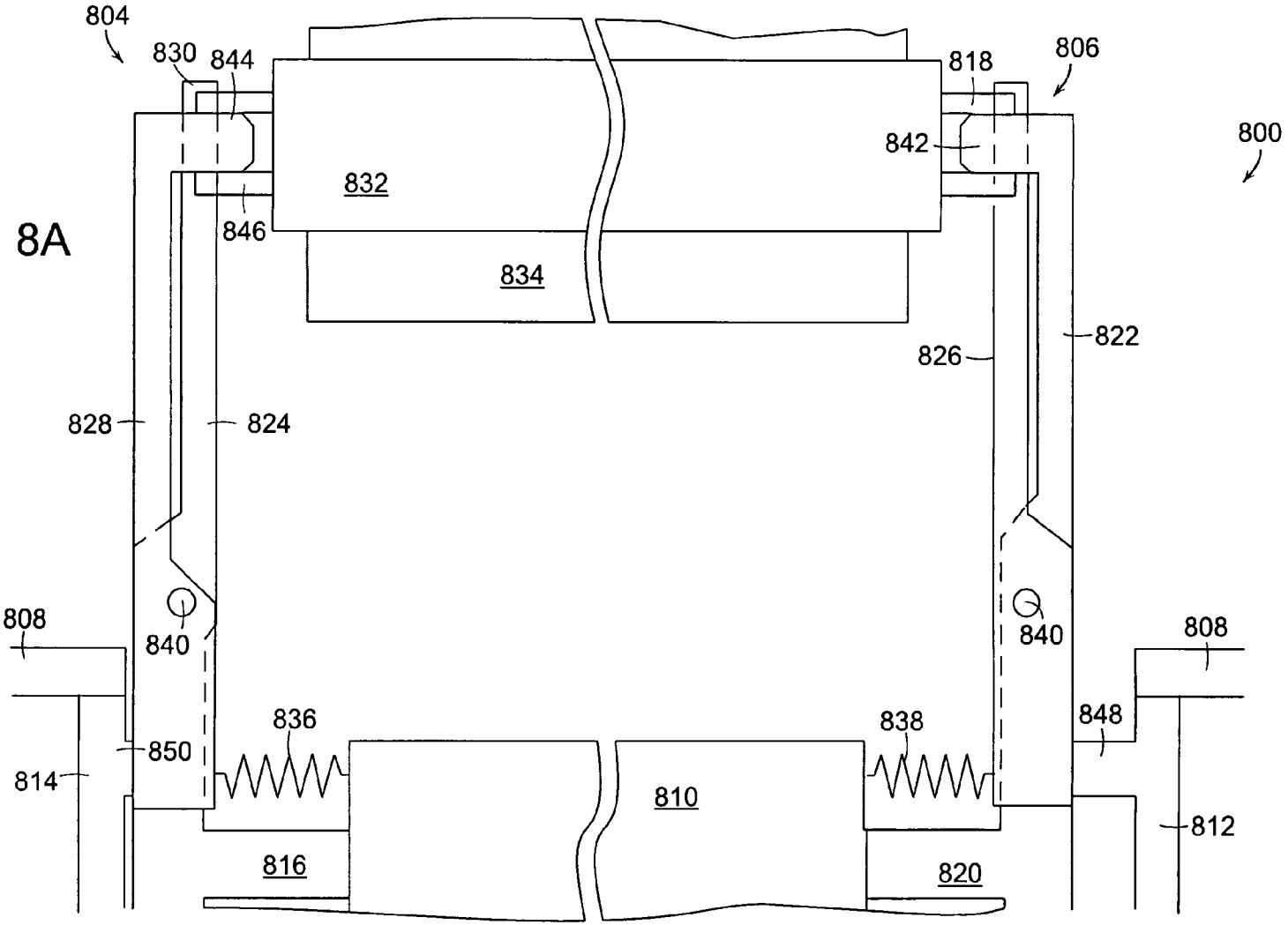
FIGS. 8A-8C are top detail views of a turret assembly chucking mechanism.
Figure 8B:
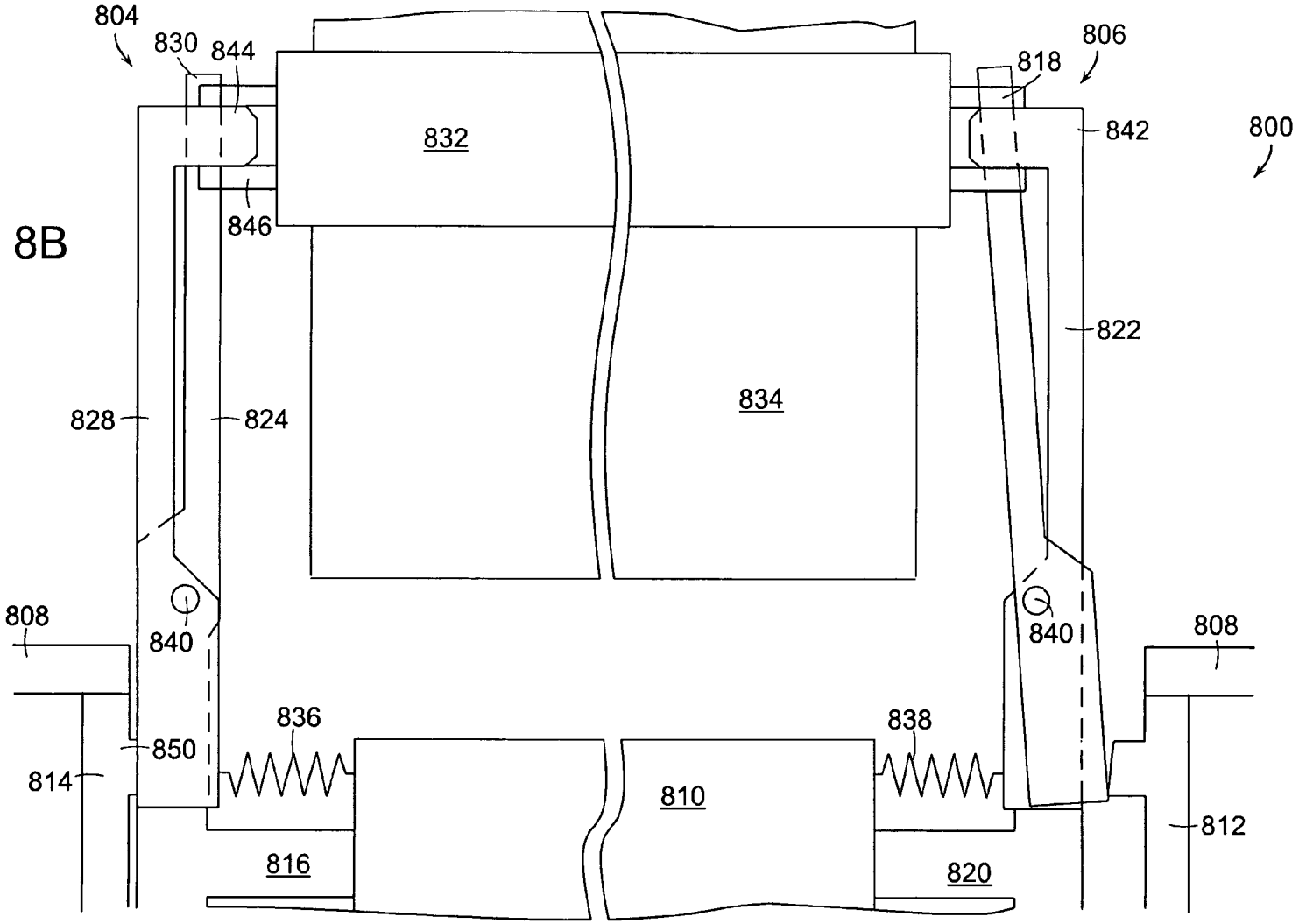
Figure 8C:
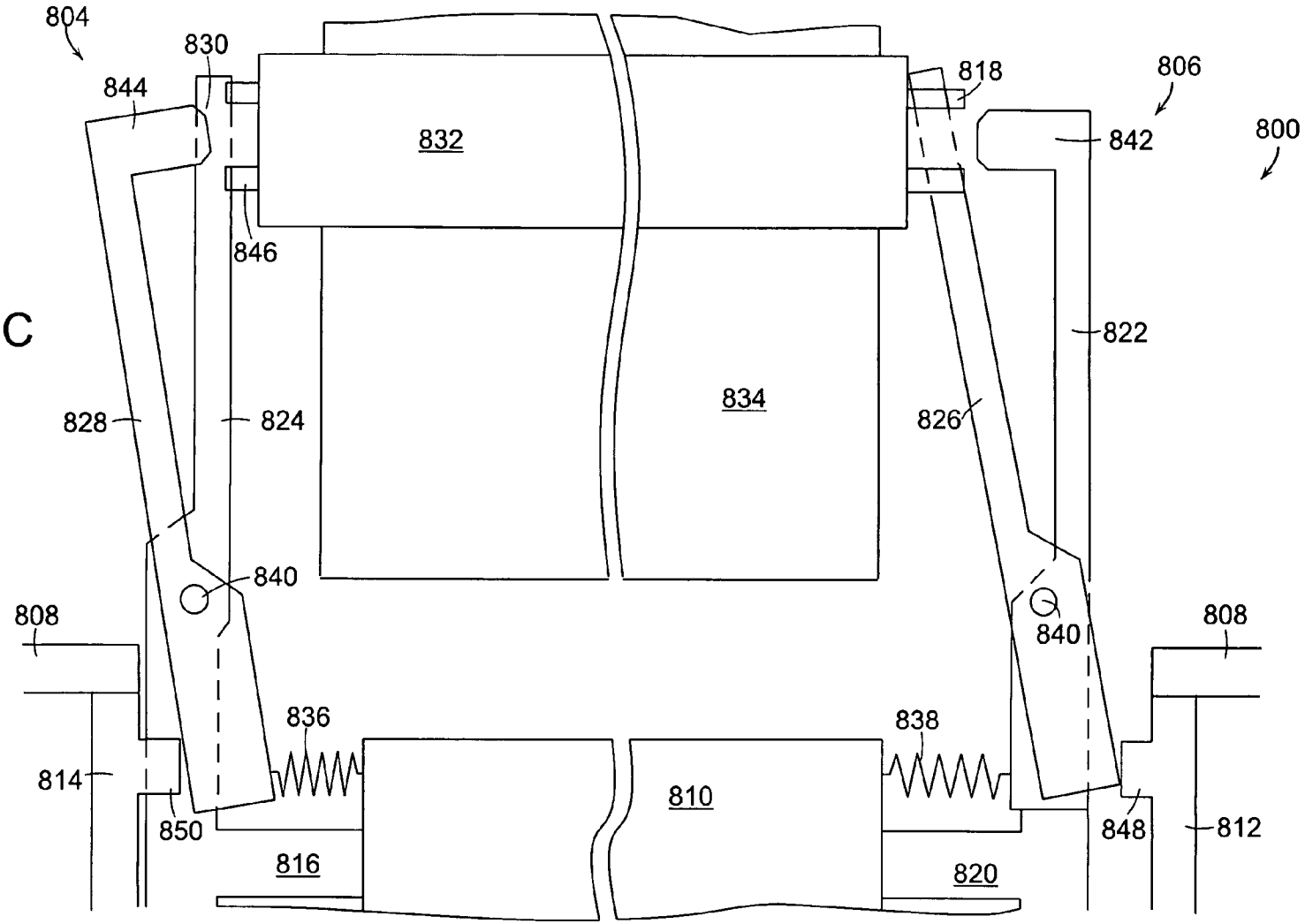

FIGS. 8A through 8C illustrate a chucking and braking mechanism for a winding turret 800. FIG. 8A illustrates a top view of a portion of a winding turret. Broken line 802 indicates the axis of rotation of the turret and also the centerline of the hub 808. In this embodiment, a turret is supporting a mandrel 832 between two turret sides 804, 806. The mandrel 832 is held by the two turret sides by pins 842, 844 on the turret arms 828, 822 that interface with sockets 818, 846 on either side of the mandrel 832. Roll 834 is building on mandrel 832. The turret sides 804, 806 are connected to a support shaft 810 by shafts 816, 820. Each turret side 804, 806 comprises a rigid member 822, 824 and a moveable member 826, 828. The moveable members 826, 828 are mounted via pivots 840 to rigid members 822, 824, and their movement is controlled by springs 836, 838 and face cams 812, 814. The face cams 812, 814 have cam surfaces 848, 850. The springs 836, 838 press the inner portions of moveable arms 826, 828 against cam surfaces 848, 850 such that inner portions of moveable arms 826, 828 follow the cam surfaces 848, 850 as the height of the cam surfaces 848, 850 change at different angular positions. The face cams 812, 814 are rigidly mounted to the hub 808 and do not rotate with the turret sides 804, 806. FIG. 8A shows the configurations of the moveable members 826, 828 when the mandrel 832 is in contact with the surface winding drum 110 and roll 834 is building on the mandrel.

FIG. 8B illustrates the winding turret 800 after the roll 834 is completed, and mandrel 832 and roll 834 move away from the surface winding drum 110. The turret 800 has rotated with respect to face cams 812, 814. With respect to face cam 812, moveable arm 826 has reached a lower portion of cam surface 848 (compared to cam surface 848 in FIG. 8A). Spring 838 pushes the inner portion of moveable arm 826 toward cam surface 848, which causes the upper portion of moveable arm 826 to contact the edge of mandrel 832. The contact and resulting friction between moveable arm 826 and mandrel 832 causes the rotation of mandrel 832 and roll 834 to slow or completely stop.

FIG. 8C illustrates the winding turret 800 in a position where mandrel 832 and roll 834 are ready to be removed from the winding turret. Here, the turret 800 has rotated with respect to face cams 812, 814. With respect to face cam 814, moveable arm 828 has reached a higher portion of cam surface 850 (compared to cam surface 850 in FIGS. 8A and 8B). Cam surface 850 pushes the inner portion of moveable arm 828 toward spring 836, causing the upper portion of moveable arm 828 to move out of contact with mandrel 832. Pin 844 is mounted to moveable arm 828, so it is removed from socket 846 of mandrel 832. The socket 846 is now supported by a cradle 830 the end of rigid arm 824. Additionally, the turret rotation also results in moveable arm 826 moving slightly further towards mandrel 832 as cam surface 848 moves to a lower position, forcing mandrel 832 and socket 818 from pin 842. The end of arm 826 is contoured to form a second cradle 827 that will support mandrel 832 during the loading and unloading operation. With pin 844 removed from socket 846 and pin 842 removed from socket 818, a robot arm 120, 220 may pick up mandrel 832 and roll 834 by moving mandrel 832 to lift socket 846 out of cradle 830 and simultaneously lift socket 818 from cradle 827. A new mandrel may then be replaced into the turret by placing a first socket of the new mandrel onto cradle 827 and placing the second socket onto cradle 830. Then, as the turret rotates in the next cut cycle, moveable arm 828 reaches the lower portion of cam surface 850 while moveable arm 826 reaches a higher position on cam surface 848. The movement of moveable arms 826 and 828 slightly shifts mandrel 832 towards arm 822, mating socket 818 with pin 842 and socket 830 with pin 828. The mandrel is now fully supported with pins 842, 844 fully engaged in sockets of the new mandrel in anticipation of the cut cycle.

The above-described means of capturing and releasing mandrels (i.e., chucking) and braking mandrels relies solely on mechanical forces for actuation. A person having ordinary skill in the art would recognize that alternative mechanisms, such as different cams configurations and different pin configurations, may be used. Also, hydraulic, pneumatic, or electronic actuation may be used. However, such hydraulics, pneumatics, or electronics add additional complexity and width requirements to a turret.

Several different types of mandrels may be used with the turrets. If a winding core, such as a cardboard tube, is to be used, the mandrels will typically incorporate an inflatable bladder. After a core is installed over a mandrel, the bladder is inflated with air or another fluid, causing the bladder to press against lugs or curved leaves that in turn press against the core, thereby holding the core in place. If the roll is going to be wound without a core, the mandrel may incorporate small holes and be wrapped with a single layer of tack film to pick up the cut film and start the plastic web 534 winding into a roll around the mandrel, and pressurizing the interior of the mandrel with air after removal from the winder, with the pressurized air escaping through the small holes and floating the full roll from the mandrel. As later described, an arc shaped flow surface (enveloper) may also direct the film around the mandrel, eliminating the need for a tack film for a coreless roll or for an adhesive on a cored roll. A coreless roll could also be formed around a mandrel with an inflatable bladder or mechanical expansion where the shaft is inflated/expanded to a large diameter for forming the roll and then deflated/retracted to a smaller diameter to remove the finished roll from the mandrel. Finally, a winding core may be held by a mandrel at its ends acting as a chuck. Use of the term "mandrel" in this application is intended to cover any of these configurations.

FIGS. 5 and 6 have shown in detail the mechanisms of a turret 114 mounted below the winding drum 110. The turrets 112 mounted above the winding drum 110 operate similarly, but the mounting may be different to accommodate the different mounting arrangement. For example, FIG. 1 shows knife edge arm 118 mounted in a different orientation relative to turret 112 than knife arm 116 relative to turret 114. In particular, the knife edge arm 118 is mounted on a straight rail because it can access its cutting position in a straight line without interfering with the robot arms 120, 220 when in its retracted position. By contrast, knife edge arm 116 cannot retract in a straight line from its cutting position without interfering with the robot arms 120, 220.

Figure 9:
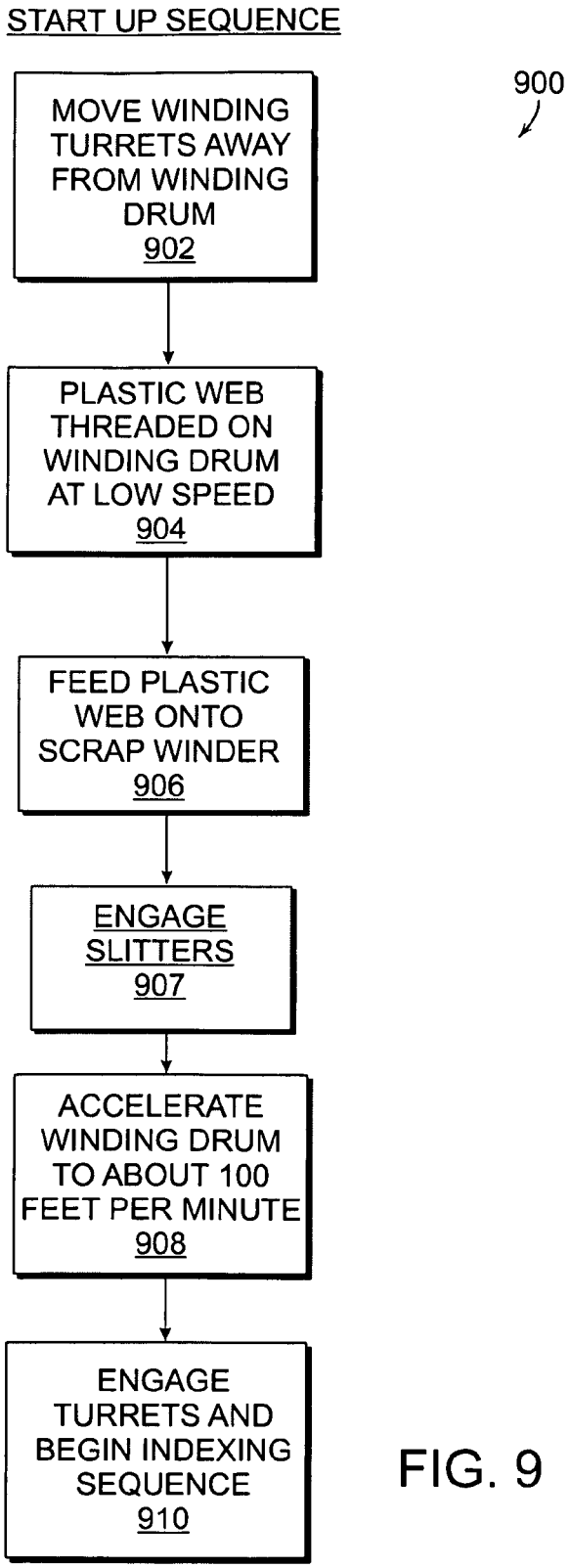
FIG. 9 is a process diagram of a start up sequence of an apparatus according to the embodiment of FIG. 1.

The disclosed system is capable of nearly continuous operation. Occasionally, however, the machine will need to be stopped for maintenance or for other reasons. When the machine is to be restarted, a start-up sequence 900 similar to that described in FIG. 9 may be followed. In a first step 902, the winding turrets 112, 114, slitters 302, and doctor blade 140 are moved away from the winding drum 110, and the plastic web 108, 134 is fed at low speed around the winding drum 110 and rolled onto a scrap roller 140. At step 907, the slitters 302 are engaged, slitting the plastic web 108 into narrow plastic webs 202, 204, 206, 208, 210, 212. The winding drum 110 is then accelerated 908 to add tension to the narrow plastic webs 202, 204, 206, 208, 210, 212, causing the webs to narrow further as described above. During this period of time in which the winding drum 110 is spinning and plastic web material 534 is moving, the plastic web material 534 is winding on the scrap roller 140 at 906 for later disposal or recycling. When the web is sufficiently stretched, the winding turrets 112, 114 engage the narrow plastic webs 202, 204, 206, 208, 210, 212 together or in any sequence, each according to an index sequence 910. The index sequence 910, described below, is then continuously operated to create plastic film rolls. The entire line is then brought up to speed.

Figure 10:
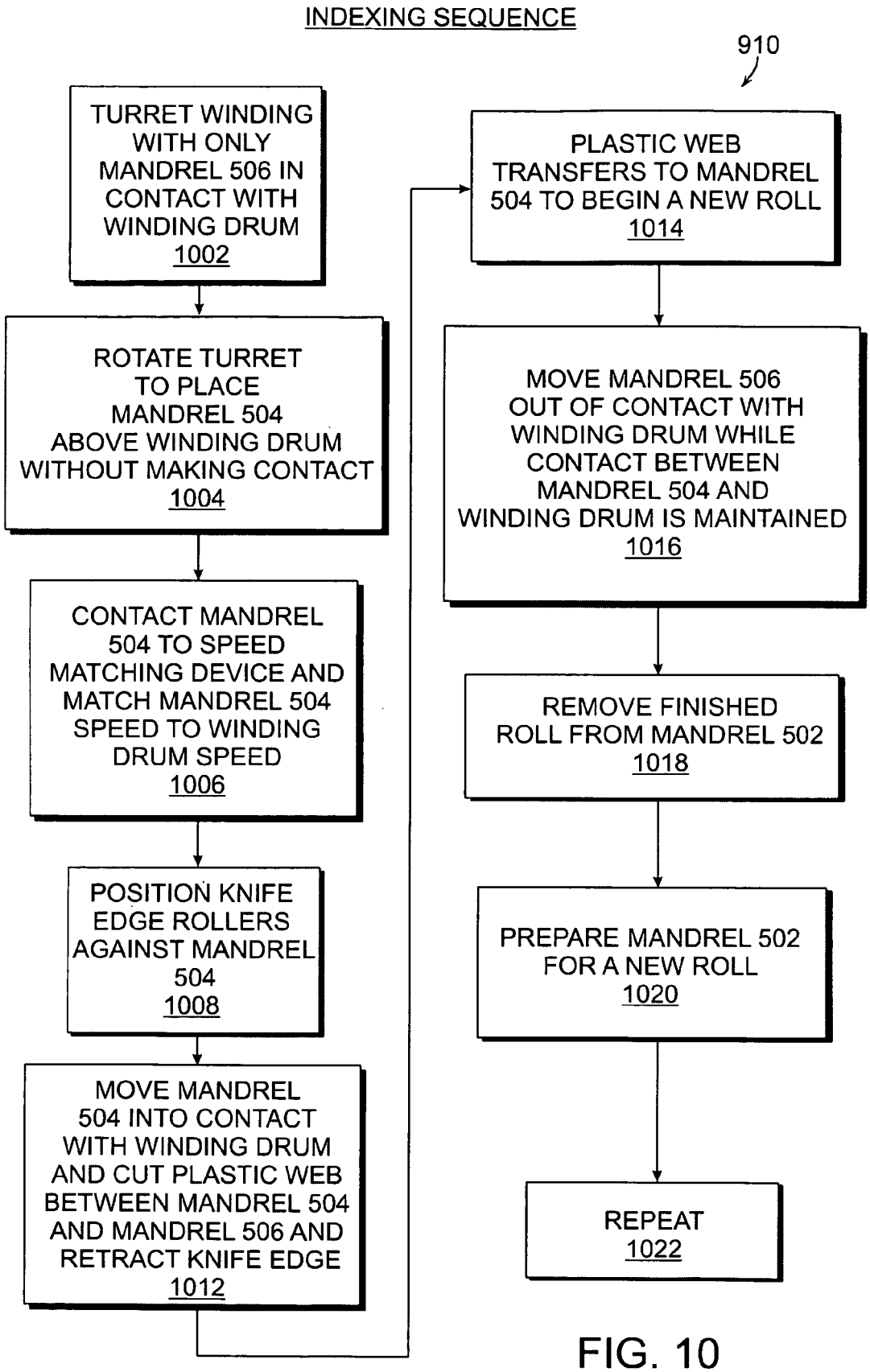
FIG. 10 is a process diagram of an indexing sequence of an apparatus according to the embodiment of FIG. 1.
Figure 11B:
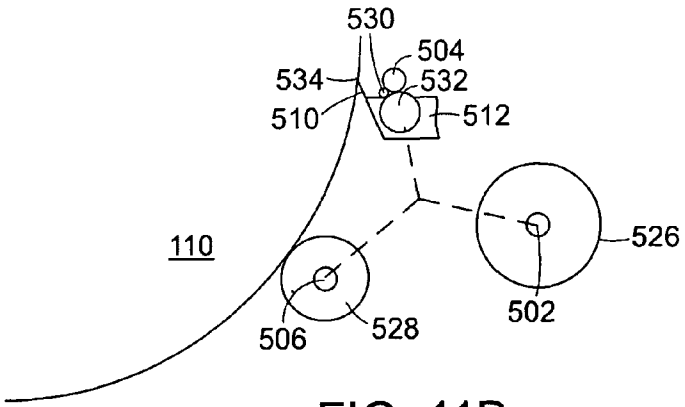
FIGS. 11A-11D are views of four positions of a three-arm turret according to the indexing sequence of FIG. 10.
Figure 11D:
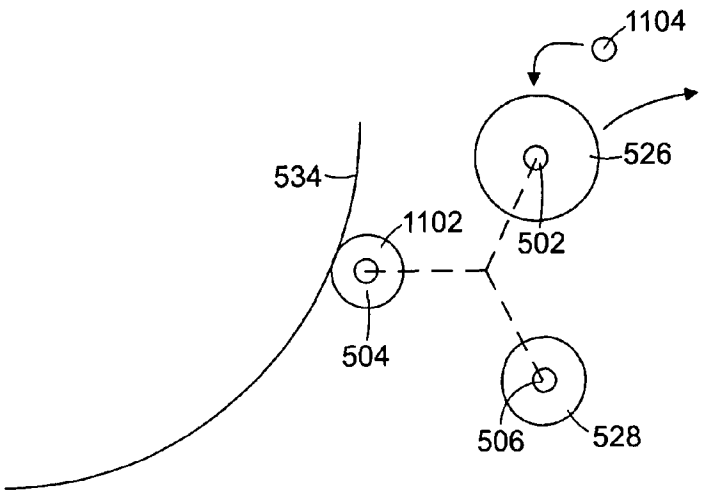
Figure 11A:
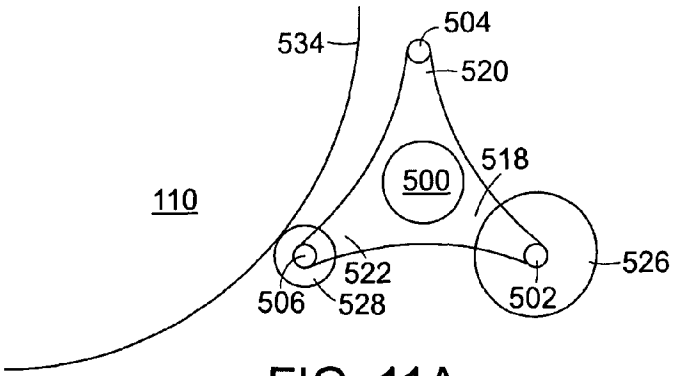

The indexing sequence 910 is illustrated in FIG. 10 with respect to winding turret 114 shown in detail in FIGS. 5 and 6. The index sequence starts with a mandrel (in this case, mandrel 506) in contact with the winding drum 110 and the plastic web 534 (step 1002). The plastic web 534 is rolling up onto mandrel 506. At this stage, the moveable portion of chassis 524 is in force mode and positioning itself to maintain a desired pressing force against the winding drum 110 via mandrel 506. Likewise, motor 706 and gearbox 708 are locked by the motor 606 supplying a torque to prevent the winding turret 114 from spinning. As roll 528 builds on mandrel 506, the moveable portion of the chassis 524 translates to maintain mandrel 506 in contact with the winding drum 110 and the plastic web 534 at a desired pressing force. At the same time, mandrel 504 is brought into close proximity with the winding drum 110 and plastic web 534 by rotating the winding turret 114 (step 1004) (see FIG. 11A).

When mandrel 504 is placed in close proximity to winding drum 110, the knife edge 510 is moved into position below mandrel 504 by support arms 512, 536, 538, 540 and actuators 516, 542 according to the process described above and illustrated in FIGS. 6C-6F. Speed-matching wheel 530 and drive wheel 532 are co-located on the support arm 512 with knife edge 510. Drive wheel 532 is rigidly mounted to support arm 512 whereas the knife edge 510 and speed-matching wheel 530 are mounted via a hinge 704, actuator arm 706, and actuator 702 to mounting arm 512. When knife edge 510 is moved into position below mandrel 504, speed-matching wheel 530 contacts mandrel 504. The drive wheel 532 spins speed-matching wheel 530, which spins mandrel 504 to match the surface speed of mandrel 504 with the surface speed 134 of the winding drum 110 (step 1006 and step 1008)(see also FIG. 11B). When mandrel 504 is substantially speed matched to winding drum 110 and roll 528 on mandrel 506 is at the desired film length, actuator 702 pushes knife edge 510 against the surface of the winding drum 110 at a shallow angle to cut the plastic web 534. Note that speed-matching wheel 530 loses contact with drive wheel 532. At substantially the same time, mandrel 504 is brought into contact with winding drum 110 and plastic web 534 (step 1012). Mandrel 504 may be brought into contact with the winding drum 110 by simply "relaxing" motor 606 for a brief moment while the moveable portion of the chassis 524 is in force mode. In one embodiment, the pressing force is increased at this time to maintain a predetermined force on each of the two mandrels simultaneously in contact with the drum. In another embodiment, the pressing force at the time of the initial web transfer to the new mandrel can be independently set to a different value than under normal winding. In another embodiment, the pressing force can be profiled to a non-constant value as the roll builds. In another embodiment, the controller corrects for the difference in the angle between the force applied to the chassis 524 and the line of action between the winding roll and the winding drum such that the pressing force between the winding roll and winding drum is maintained at the desired value, regardless of the angular position of the turret. Motor 606 may be relaxed by de-energizing the motor or by actuating a clutch to decouple hub 500 from the motor 606. By relaxing motor 606, the winding turret 114 will be free to rotate. The pressing force on mandrel 506 will rotate the winding turret 114, bringing mandrel 504 into contact with the winding drum 110 such that similar amounts of pressing force are exerted through mandrel 506 and mandrel 504. Note that in this described embodiment, mandrel 504 maintains contact with speed-matching wheel 530. Alternatively, mandrel 504 and speed-matching wheel 530 may lose contact when the knife edge 510 and mandrel 504 are pushed against the winding drum 110.

Figure 11C:
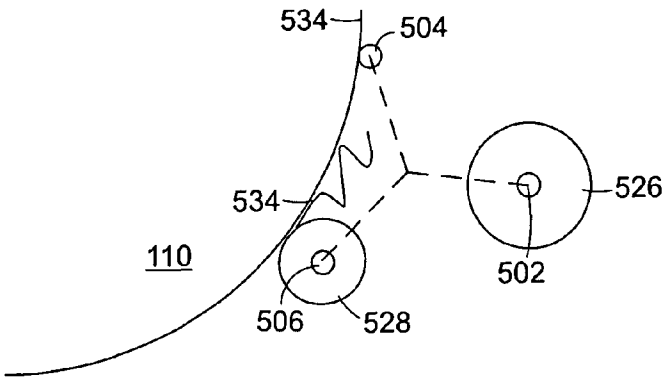

Once plastic web 534 is severed, plastic web 534 begins to wind around mandrel 504 (step 1014) and the plastic web 534 downstream of knife edge 510 finishes winding onto roll 528 on mandrel 506. After the mandrel 504 contacts the winding drum 110 and is winding the plastic web 524, motor 606 once again locks to maintain the winding turret 114 in a single angular position (step 1016) (see also FIG. 11C). As the plastic web 534 rolls onto mandrel 504, a new roll 1102 begins to build. To maintain a constant force as the new roll builds, the chassis 524 begins to translate away from the winding drum 110, consequently moving the completed roll 528 out of contact with the winding drum 110. Alternatively, it may be advantageous to rotate turret hub 500, 500' by a small amount to move completed roll out of contact to insure good contact for new roll 1102. After the knife edge 510 retracts out of the winding area (by reversing the process described above in FIGS. 6C-6F) and roll 528 is out of contact with the winding drum 110, the turret hub 500 rotates further and the chassis 524 translates to move mandrel 506 and finished roll 528 further away from the winding drum 110 and brakes mandrel 506 to stop its rotation, and also to keep mandrel 504 and its winding roll 1102 in contact with the winding drum 110 and the plastic film 534 (step 1016)(see also FIG. 11D). During the index sequence 910 thus far, mandrel 502 has been maintained away from winding drum 110. As the index sequence 910 repeats (step 1022), mandrel 502 becomes the next mandrel to be wound when the plastic web 534 is separated from roll 1102 being wound on mandrel 504. After mandrel 506 is moved away from the winding drum 110, mandrel 502 and its full roll 526 are removed from turret arm 518 by robot arm 120. Robot arm 120 or 220 then places a new mandrel 1104 onto the end of the turret arm 518 (steps 1018 and 1020).

Figure 17:
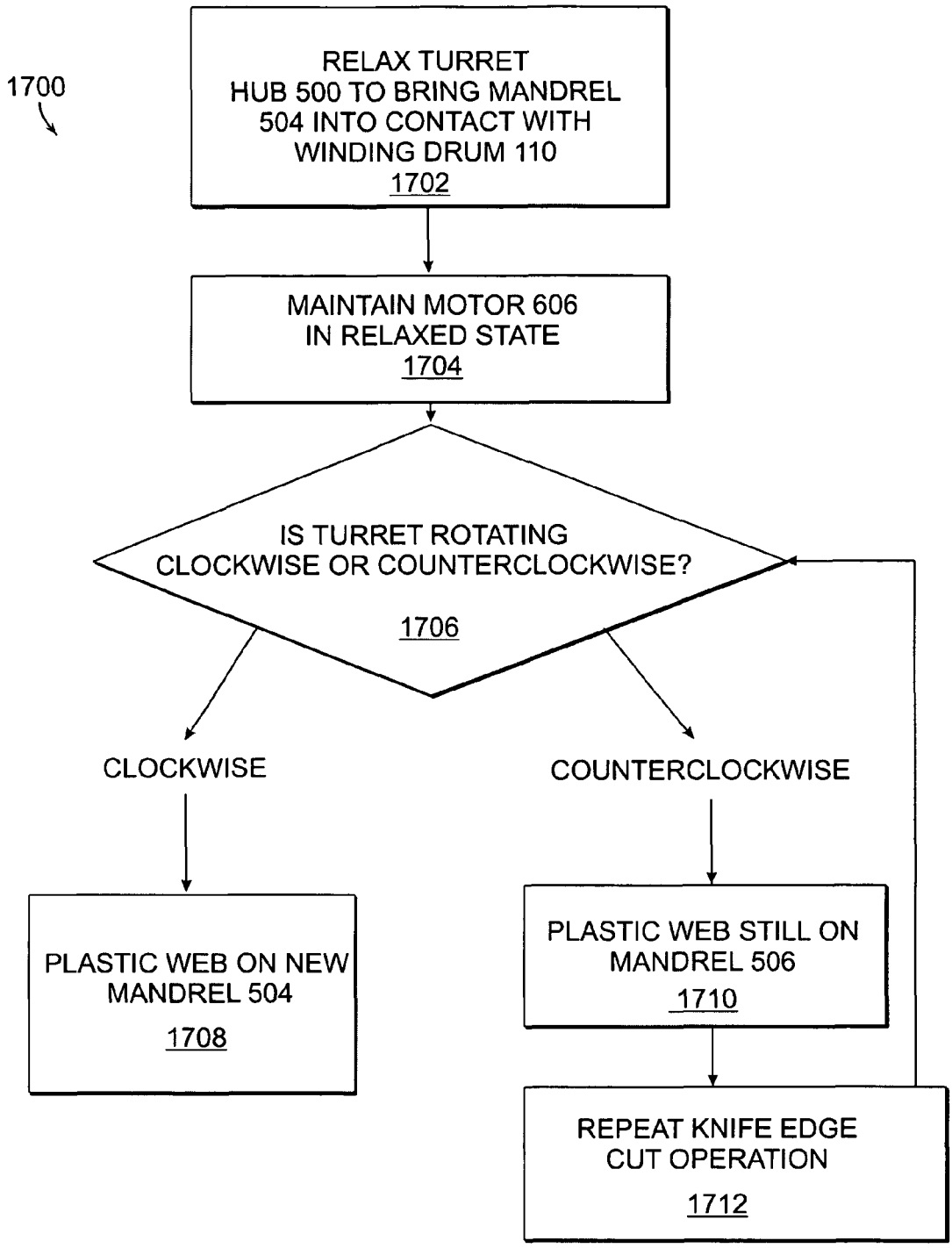
FIG. 17 is a process diagram of a testing sequence to automatically determine whether a plastic web has transferred to a new mandrel.

Returning to FIG. 11C and step 1012, an alternative procedure 1700, shown in FIG. 17, may be followed to detect whether a plastic web 534 that has been cut by a knife edge is winding on a new mandrel 504 or is continuing to wind on the first mandrel (506) because the new mandrel 504 failed to pick up the plastic web 534. In this alternative method, when mandrel 504 contacts the winding drum 110 (step 1702), motor 606 remains in its relaxed state (step 1704), such that mandrel 504 and roll 528 on mandrel 506 are in contact with the winding drum. A sensor (not shown) on the hub 500 detects rotation of the hub 500 (step 1706). With respect to FIG. 11C, if the hub 500 is detected rotating in a clockwise direction, then mandrel 504 is growing in diameter, which means that the plastic web 534 successfully transferred to the mandrel 504 (step 1708). However, if the hub 500 is detected rotating in a counterclockwise direction, then roll 528 on mandrel 506 is continuing to grow, which means that the plastic web 534 missed the transfer to mandrel 504 and is still building on roll 528 on mandrel 506 (step 1710). In this second case, the knife edge 51 cut operation is repeated (step 1712) and the method 1700 loops back to step 1706 until the plastic web 534 is detected in mandrel 504 (step 1708).

Alternative means may be used to detect whether the plastic web 534 successfully transferred to mandrel 504. For example, a sensor (not shown) may be placed between mandrel 504 and mandrel 506. If the sensor (not shown) detects plastic web 534 on the winding drum 110, then the plastic web 534 did not transfer. Sensor types include, but are not limited to, optical sensors and conductive brushes that pass an electric current when in contact with the metal winding drum 110 but are insulated when a plastic web 534 is on the winding drum 110.

FIGS. 12A-12D illustrate the index sequence 910 with respect to a winding turret 1200 with four arms 1216, 1218, 1220, and 1222. As before, the sequence begins with a single mandrel (in this case, mandrel 1202) in contact with the winding drum 110 and the plastic web 534. The plastic web 534 is rolling up onto mandrel 1202 to form roll 1210. As roll 1210 builds on mandrel 1202, the turret 1200 is in force mode and translates to maintain mandrel 1202 and roll 1210 in contact with the winding drum 110 and the plastic web 534. The turret also rotates to move mandrel 1204 close to the winding drum 110 at a position before mandrel 1202 with respect to the winding drum 110 and the plastic web 534 (see FIG. 12A).

Figure 12A:
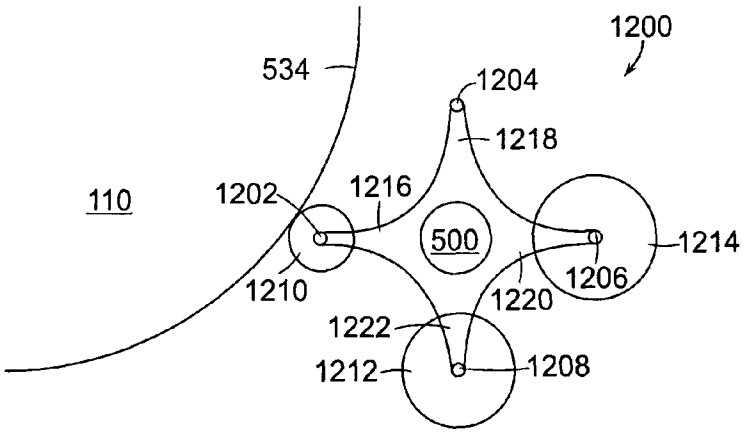
FIGS. 12A-12D are views of four positions of a four-arm turret according to the indexing sequence of FIG. 10.
Figure 12B:
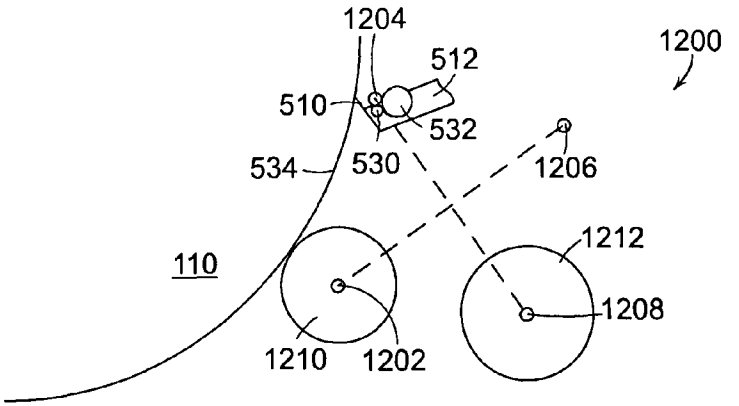
Figure 12C:
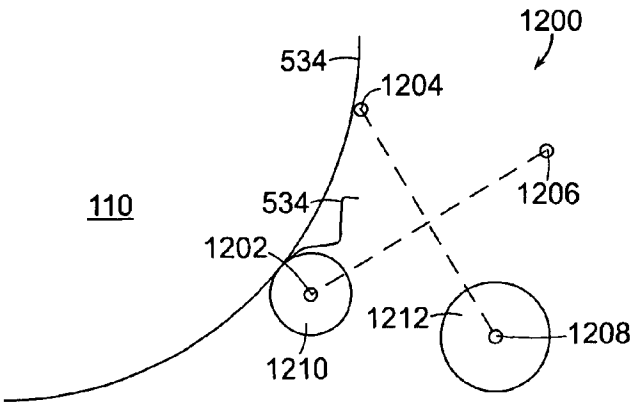
Figure 12D:
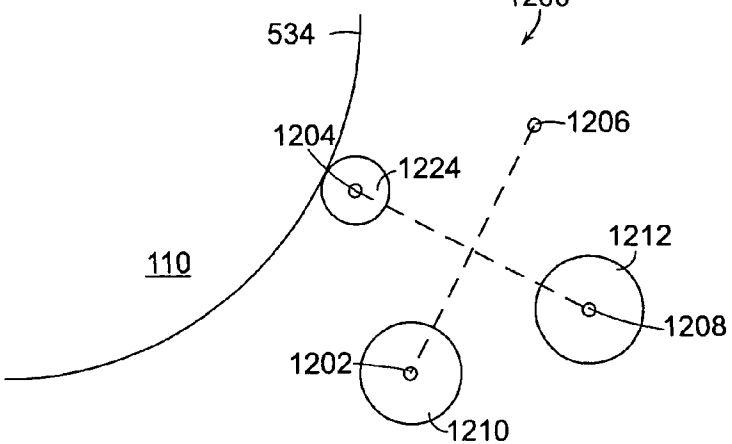

The knife edge 510 is moved into position below mandrel 1204 by support arms 512, 536, 538, 540 and actuators 516, 542 according to the process described above in FIGS. 6C-6F. Speed-matching wheel 530 and drive wheel 532 are co-located on the support arm 512 with knife edge 510. Drive wheel 532 is rigidly mounted to support arm 512 whereas the knife edge 510 and speed-matching wheel 530 are mounted via a hinge 704, actuator arm 706, and actuator 702 to mounting arm 512. When the knife edge 510 is moved into position below mandrel 1204, speed-matching wheel 530 makes contact with mandrel 1204 (see FIG. 12B). The index sequence 910 may be optionally altered such that the robot arm 120 has removed mandrel 1206 when the knife edge support arm 512 moves into position as shown in FIG. 12B, thereby providing a clearer path for the support arm 512 to access its position with respect to the mandrel 1204 and the winding drum 110. As in the three-arm turret example of FIGS. 11A-11D, after mandrel 1204 is speed matched to winding drum 110, motor 606 is relaxed to bring mandrel 1204 into contact with the winding drum 110 and the plastic web 534. At substantially the same time, the knife edge 510 cuts the plastic web 534 between mandrels 1202 and 1204.

Once the plastic web 534 is severed, plastic web 534 begins to wind around mandrel 1204. Optionally, knife edge 510 may remain in close proximity to the winding drum 534 to direct a free end of the plastic web 534 (see FIG. 12C) to mandrel 1204 to begin winding a new roll (1224 in FIG. 12D). Alternatively, the knife edge 510 may be retracted. As new roll 1224 begins to build on mandrel 1204, the chassis 524 begins to translate away from the winding drum 110, consequently moving the completed roll 1210 out of contact with the winding drum 110.

The plastic web 534 downstream of knife edge 510 finishes winding onto roll 1210 on mandrel 1202. After roll 1210 is complete and the knife edge support arm 512 has retracted (by reversing the process described above in FIGS. 6C-6F), the turret hub 500 rotates and the chassis 524 translates to move mandrel 1202 and finished roll 1210 further away from the winding drum 110 and brakes mandrel 1202 to stop its rotation, and also maintains mandrel 1204 and its winding roll (1224 in FIG. 12D) in contact with the winding drum 110 and plastic film 534 (see FIG. 12D). Similar to the index sequence 910 for the three-arm turret illustrated in FIGS. 11A-11D, mandrels 1208 and 1206 have both been maintained away from the winding drum 110. As the index sequence repeats, mandrel 1206 becomes the next mandrel to be wound when the plastic web 534 is separated from roll 1224 being wound on mandrel 1204 and mandrel 1208 will follow mandrel 1206. As mandrel 1202 rotates away from the winding drum 110, mandrel 1208 and its full roll 1212 are removed from turret arm 1222 by robot arm 120. Robot arm 120 then places a new mandrel 1208 onto the end of turret arm 1222. The robot arm 120 may remove the mandrel 1208 and full roll 1212 at any time while the mandrels are out of contact with winding drum 110. FIG. 12A shows an embodiment of the index sequence in which mandrels 1208, 1206 each carry a full roll 1212, 1214. Thus, in that embodiment, mandrel 1206 and roll 1214 would be removed from turret arm 1220 prior to mandrel 1208 and roll 1212 being removed from turret arm 1222.

For a winding drum with multiple winding turrets, it is advantageous to operate each turret at a different step in the index sequence. By operating the turrets at different steps of the index sequence, the turrets may share robot arms to remove and replace mandrels because only one or two turrets will require such removal and replacement at a time.

Figure 13:
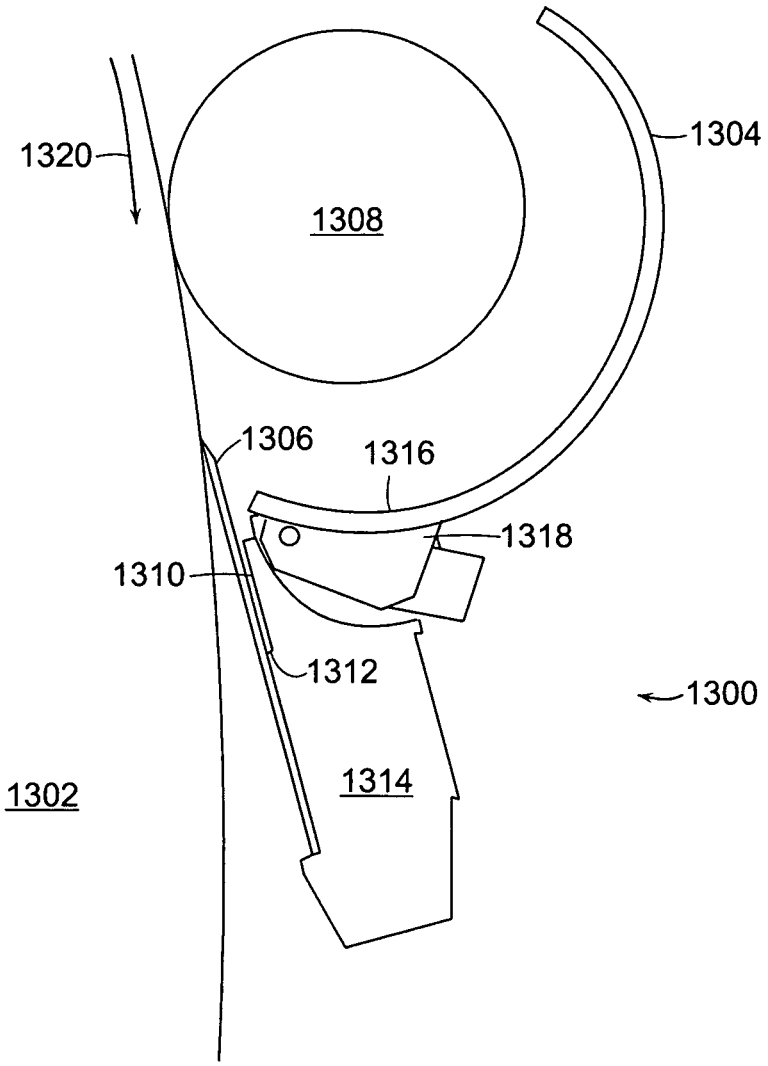
FIG. 13 is a side view of an embodiment of a knife edge assembly for a turret assembly.

FIGS. 13-16B show an alternative embodiment of a knife edge associated with a winding turret. FIG. 13 shows the interrelationship of the cutoff knife assembly 1300, winding drum 1302 and arc shaped air flow surface (enveloper) 1304 at the time of transfer to a new mandrel 1308. At the time of transfer, as previously described, the cutoff knife blade 1306 is brought into contact with the surface of winding drum 1302, the knife edge 1306 pointed in a direction opposite to the direction of travel 1320 of the winding drum 1302. As the tips of cutoff knife 1306 contact the surface of winding drum 1302 they pierce and sever plastic web (not shown), which is carried on the surface of the winding drum 1302, and simultaneously lift the plastic web from the surface of the winding drum 1302. Additionally, to aid in lifting the film from the drum surface and wrapping it around new mandrel 1308, pressurized air is discharged from air flow path 1310 in a direction opposite to the direction of drum rotation and parallel to cutoff knife 1306. Air flow path 1310 is formed between cutoff knife blade 1306 and relieved surface 1312 of knife support bar 1314. An arc shaped air flow surface 1304 (also known as an enveloper) attached to knife support bar 1314 surrounds an appreciable portion of the new mandrel 1308. Arc shaped air flow surface (enveloper) 1304 additionally contains a series of air discharge openings 1316 located towards the cutoff knife blade 1306. These air discharge openings 1316 are in operative communication with a pressurized air plenum 1318 located on the side of arc shaped air flow surface away from new mandrel 1308, and they are oriented so as to discharge air in a direction substantially parallel to the surface of new core 1308. Although not shown in FIG. 13, arc shaped air flow surface 1304 extends axially over a significant fraction of the total length of cutoff knife assembly 1300.

Figure 14A:
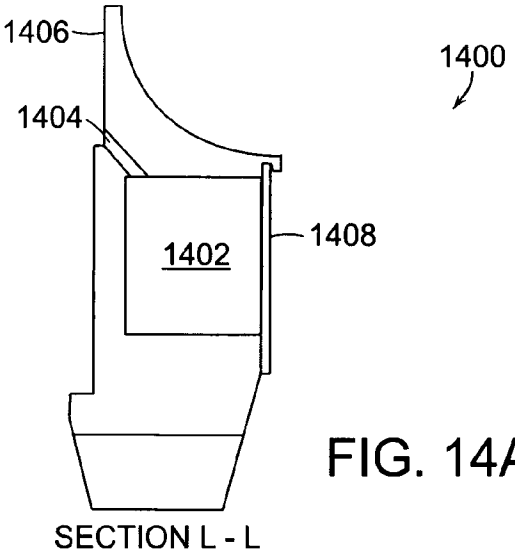
FIGS. 14A and 14B are a side view and front view, respectively, of a knife edge support bar for the knife edge assembly of FIG. 13.

FIG. 14A shows details, including a cross-section, of knife support bar 1400 according to the present invention. As shown in the cross-section, there is an internal air plenum 1402 for receiving pressurized air from a source (not shown), and for discharging the pressurized air through discharge passages 1404. The discharge passages 1404 provide a flow path for pressurized air from plenum 1402 to the relieved surface 1406 of knife support bar 1400. The plenum 1402, in this example embodiment, is enclosed by a cover plate 1408. As previously indicated in the discussion of FIG. 13, relieved surface 1406 and cutoff knife blade 1306 (not shown in FIG. 14A) form a flow path 1310 for air parallel to the knife blade that is used to help lift the free end of cut film (not shown) from the winding drum 1302 and direct the end towards the new mandrel 1308.

Figure 14B:
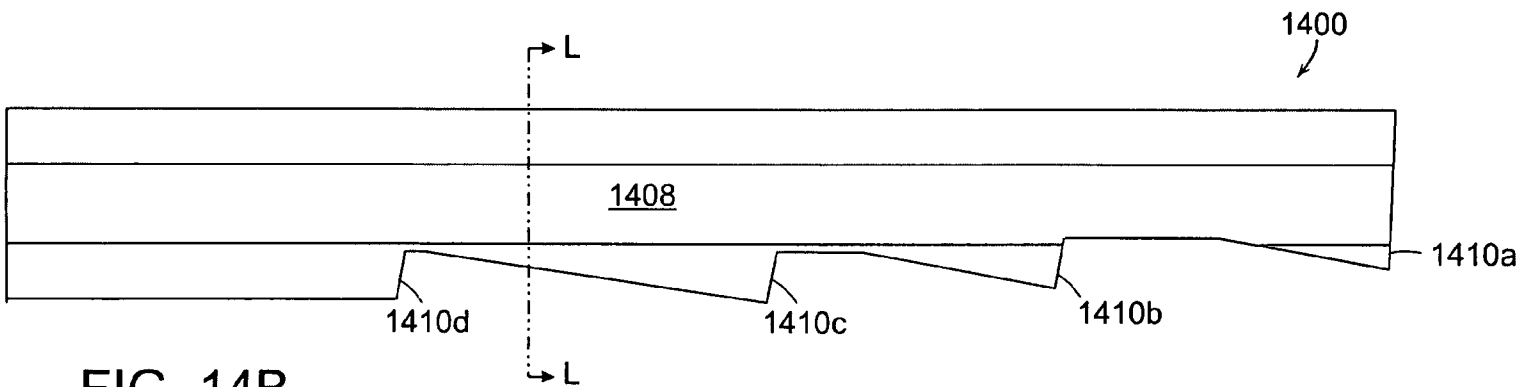

FIG. 14B shows the knife support bar 1400 from FIG. 14A facing the cover plate 1408. Plenum 1402 (not shown in FIG. 14B) is fed by a series of inlet ports (not shown) on cut faces 1410*a-d*. Using multiple inlet ports (not shown) allows for better air pressure distribution in the plenum 1402 and for the use of smaller fittings.

Figure 15:
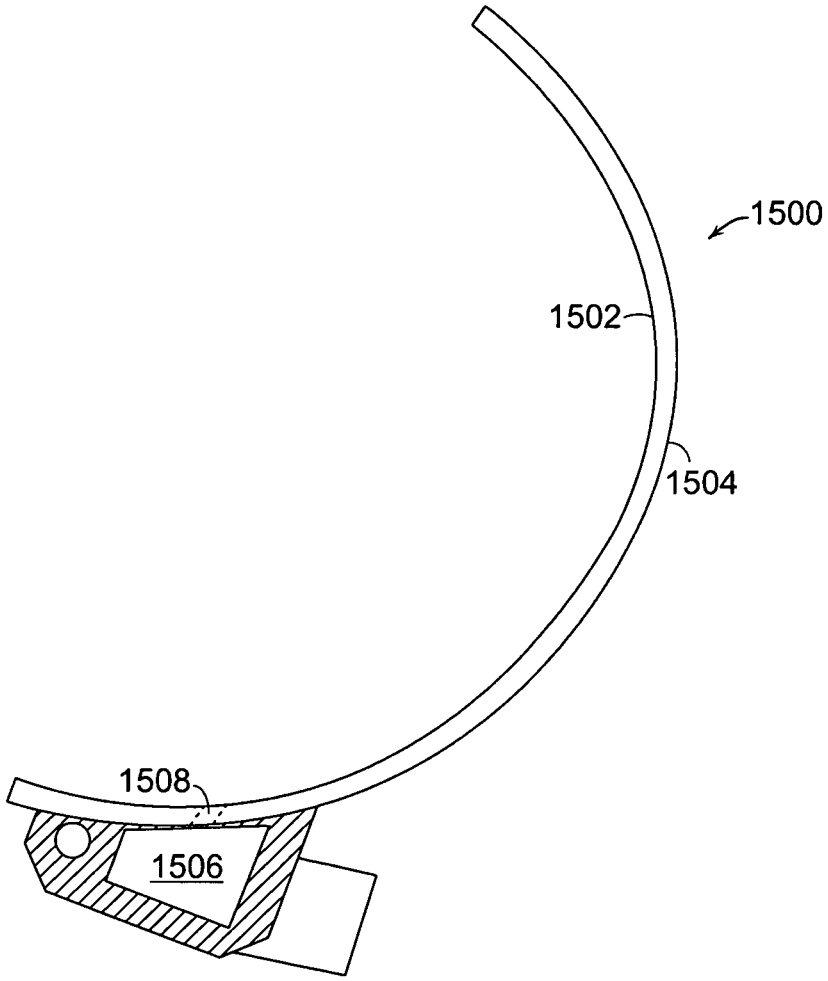
FIG. 15 is a side view of an arc shaped flow surface (enveloper) that may attach to the knife edge assembly of FIG. 13.

FIG. 15 shows a cross-section through an arc shaped air flow surface (enveloper) 1500. As shown, arc shaped air flow surface (enveloper) 1500 has a first surface 1502 disposed towards a new mandrel 1308 (not shown in FIG. 15) and a second surface 1504 disposed away from the new roll 1308. The second surface 1504 additionally caries an air plenum 1506, which is in turn supplied with pressurized air from an air supply source (not shown). Air plenum 1506 runs axially along a central portion of the arc shaped flow surface 1500, and is disposed towards the lower end, i.e. the end that would be closest to cutoff knife (1306, for example) in operation. There are a series of angularly oriented orifices 1508 that run to the front surface 1502 of the arc shaped air flow surface from the back surface 1504 axially aligned with the plenum 1506. Orifices 1508 are oriented so that the orifice at the first surface 1502 of air flow surface 1500 lies further in the direction of rotation of the new core than the orifices 1508 on the second surface 1504. Orifices 1508 are used to discharge pressurized air during the cutover process to encourage the cut end of film (not shown) to wrap around the new mandrel 1308 (not shown in FIG. 15) as hereinafter described.

Figure 16B:
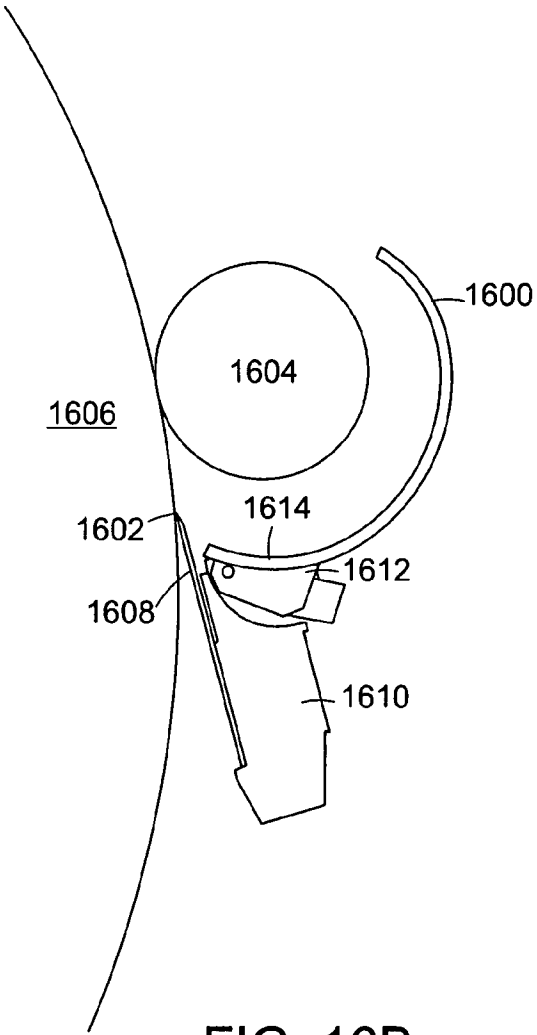
FIGS. 16A and 16B are side views of the knife edge assembly of FIG. 13 in position to contact and contacting, respectively, a winding drum.
Figure 16A:
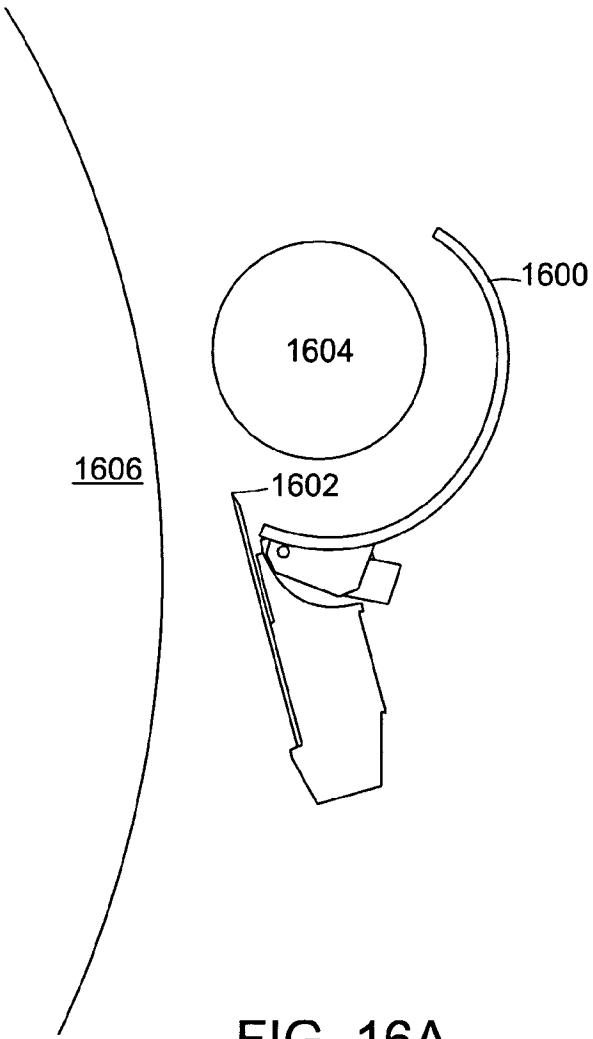

The cut and transfer process is best described by reference to FIGS. 16A and 16B. As shown in FIG. 16A cutoff knife blade 1602 is brought to a position adjacent to new mandrel 1604 with the tips of cutoff knife blade 1602 a short distance above the surface of winding drum 1606. This position is maintained while a speed matching drive (not shown) accelerates new mandrel 1604 to the speed of an incoming plastic web (not shown). As shown in FIG. 16B, when the speed of new mandrel 1604 substantially matches that of the incoming web (not shown), cutoff knife blade 1602 is brought into contact with web (not shown) and drum 1606 by pivoting the knife assembly on its hinged carrier (not shown). Simultaneously with the initiation of the pivoting action bringing cutoff knife blade 1602 into contact with web (not shown) and drum 1606, pneumatic valves controlling the supply of pressurized air to internal plenum 1402 (not shown in FIG. 16B) of knife support bar 1610 and to plenum 1612 of arc shaped flow surface (enveloper) 1402 (not shown in FIG. 16B) are opened. Supplying pressurized air to plenum 1402 (not shown in FIG. 16B) results in a discharge of air through air flow path 1608 which tends to lift web (not shown) from the surface of drum 1606, while air discharge through orifices 1614 of arc shaped flow surface (enveloper) 1600 tends to "float" the cut end of the film (not shown) around new mandrel 1604. In one embodiment, air may be discharged through orifices 1608, 1614 prior to initiating the cut to ensure that the air flow is established before plastic web is severed. After enveloping the mandrel 1604, the plastic web (not shown) leading edge makes contact with the upstream portion of the plastic web on the winding drum 1606 and tacks to itself. The subsequent wraps of film hold the underlying layers by means of the slight tension that remains in the plastic web. The knife assembly is then withdrawn to its stored position until needed for the next roll changeover.

While this invention has been particularly shown and described with reference to embodiments thereof, it will be understood by those skilled in the art that various changes in form and detail may be made without departing from the scope of the invention encompassed by the appended claims.

What is claimed is:

1. An apparatus for indexing winding cores on a winder, comprising:

a winding drum configured to carry a continuous plastic web;

a plurality of winding stations configured to translate toward and away from the surface of the winding drum, each winding station carrying:

a winding turret with a plurality of winding positions, a mandrel attached at each winding position, the winding turret rotating about a hub;

a knife edge coupled to an actuator that presses the kneife edge against the continuous plastic web on the surface of the winding drum, thereby cutting the continuous plastic web between two positions when actuated; and a controller configured to:

press a first mandrel against the winding drum such that the continuous plastic web winds on the first mandrel;

move a second mandrel against the winding drum into contact with the continuous plastic web;

actuate the knife edge to cut the continuous plastic web between the first mandrel and the second mandrel to start winding the continuous plastic web on the second mandrel; and thereafter move the first mandrel away from the surface of the winding drum;

each winding station winding one of a plurality of continuous plastic webs; and, each winding station being located at either a first circumferential location or a second circumferential location relative to the winding drum, and wherein successive turrets are at alternate circumferential locations.

2. The apparatus of claim 1 wherein each of the plurality of winding stations may longitudinally translate relative to the surface of the winding drum.

3. The apparatus of claim 1, wherein the winding drum is a surface winding drum.

4. The apparatus of claim 1 wherein the mandrels are accelerated by the surface of the winding drum.

5. The apparatus of claim 1 wherein the winding turret rotating about the hub is controlled via the controller with an electric servomotor connected to the hub.

6. The apparatus of claim 5 wherein the electric servomotor is connected to the hub by a pulley and a flexible drive.

7. The apparatus of claim 1 wherein each mandrel is a core around which the plastic web is wound.

8. The apparatus of claim 1 wherein the continuous plastic web is wound onto a starter material pre-applied to each mandrel.

9. An apparatus for indexing winding cores on a winder, comprising:

a winding drum configured to carry a continuous plastic web;

as plurality of winding stations configured to translate toward and away from the surface of the winding drum, each winding station carrying:

a winding turret with a plurality of winding positions, a mandrel attached at each winding position, the winding turret rotating about a hub;

a knife edge coupled to an actuator that presses the kneife edge against the continuous plastic web on the surface of the winding drum, thereby cutting the continuous plastic web between two positions when actuated;

a controller configured to:

press a first mandrel against the winding drum such that the continuous plastic web winds on the first mandrel;

move a second mandrel against the winding drum into contact with the continuous plastic web;

actuate the knife edge to cut the continuous plastic web between the first mandrel and the second mandrel to start winding the continuous plastic web on the second mandrel;

thereafter move the first mandrel away from the surface of the winding drum; and, a friction drive that contacts the second mandrel prior to the controller moving the second mandrel against the surface of the winding drum and accelerates the second mandrel to substantially match the second mandrel surface speed with the surface speed of the winding drum.

10. The apparatus of claim 9 wherein the friction drive is mounted to an articulated arm that moves the friction drive into and out of association with the second mandrel.

11. An apparatus for indexing winding cores on a winder, comprising;

a winding drum configured to carry a continuous plastic web;

a plurality of winding stations configured to translate toward and away from the surface of the winding drum, each winding station carrying:

a winding turret with a plurality of winding positions, a mandrel attached at each winding position, the winding turret rotating about a hub;

a knife edge coupled to an actuator that presses the knife edge against the continuous plastic web on the surface of the winding drum, thereby cutting the continuous plastic web between two positions when actuated;

a controller configured to:

press a first mandrel against the winding drum such that the continuous plastic web winds on the first mandrel;

move a second mandrel against the winding drum into contact with the continuous plastic web;

actuate the knife edge to cut the continuous plastic web between the first mandrel and the second mandrel to start winding the continuous plastic web on the second mandrel;

thereafter move the first mandrel away from the surface of the winding drum;

wherein the knife edge presses against the continuous plastic web on the surface of the winding drum at a shallow angle;

the apparatus further comprising:

a pressurized air source; and one or more passages through which air from the pressurized air source is directed along a flat surface of the knife edge and thereupon impinge on the surface of the winding drum at substantially the shallow angle, the impinging air lifting a leading edge of the plastic film from the surface of the winding drum when the knife edge cuts the continuous plastic web.

12. The apparatus of claim 11 wherein the pressurized air source is a plenum inside a knife edge support.

13. The apparatus of claim 11 further comprising a curved enveloper spaced from and oriented substantially parallel to the second mandrel, the curved enveloper directing the leading edge of the plastic film onto the second mandrel.

14. The apparatus of claim 13 further comprising a second set of one or more passages through which pressurized air from a pressurized air source is directed substantially along the curved enveloper, directing the edge of the plastic film onto the second mandrel.

15. An apparatus for indexing winding cores on a winder, comprising:

a winding drum configured to carry a continuous plastic web;

a plurality of winding stations configured to translate toward and away from the surface of the winding drum, each winding station carrying:

a winding turret with a plurality of winding positions, a mandrel attached at each winding position, the winding turret rotating about a hub;

a knife edge coupled to an actuator that presses the kneife edge against the continuous plastic web on the surface of the winding drum, thereby cutting the continuous plastic web between two positions when actuated;

a controller configured to:

press a first mandrel against the winding drum such that the continuous plastic web winds on the first mandrel;

move a second mandrel against the winding drum into contact with the continuous plastic web;

actuate the knife edge to cut the continuous plastic web between the first mandrel and the second mandrel to start winding the continuous plastic web on the second mandrel;

thereafter move the first mandrel away from the surface of the winding drum; and, a cylindrical roller around a circumferential portion of which the continuous plastic web is directed prior to being carried by the winding drum;

a plurality of circumferential grooves located at longitudinal positions on the roller, the circumferential grooves located underneath the position of the continuous plastic web on the roller;

a knife edge, at least a portion of which is located within one of the plurality of circumferential grooves; and at least one finger that is outboard of the knife edge and is located in at least one circumferential groove, the at least one finger configured to lift a cut edge of the continuous plastic web and direct the cut edge of the continuous plastic web to a conveyor that transports the edge of the plastic web away from the apparatus.

16. The apparatus of claim 15 wherein each of the plurality of circumferential grooves is located at a longitudinal position correspondence to a different width of continuous plastic web.

* * * * *